US010885884B2

(12) United States Patent
Takahashi et al.

(10) Patent No.: US 10,885,884 B2
(45) Date of Patent: Jan. 5, 2021

(54) PIVOT MEMBER AND KEYBOARD APPARATUS

(71) Applicant: YAMAHA CORPORATION, Hamamatsu (JP)

(72) Inventors: Ken Takahashi, Hamamatsu (JP); Shunsuke Ichiki, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 0 days.

(21) Appl. No.: 16/574,599

(22) Filed: Sep. 18, 2019

(65) Prior Publication Data

US 2020/0013378 A1 Jan. 9, 2020

Related U.S. Application Data

(63) Continuation of application No. PCT/JP2018/011403, filed on Mar. 22, 2018.

(30) Foreign Application Priority Data

Mar. 24, 2017 (JP) ..... 2017-060138

(51) Int. Cl.
*G10C 3/103* (2019.01)
*G10C 3/12* (2006.01)
*B41J 5/10* (2006.01)

(52) U.S. Cl.
CPC ..... *G10C 3/103* (2013.01); *B41J 5/10* (2013.01); *G10C 3/12* (2013.01)

(58) Field of Classification Search
CPC ..... G10C 3/103; G10C 3/12; B41J 5/10
See application file for complete search history.

(56) References Cited

U.S. PATENT DOCUMENTS 3,616,723 A * 11/1971 Gullickson ..... G10C 3/12 84/478
4,523,702 A * 6/1985 Viio ..... A45F 5/00 206/479

(Continued)

FOREIGN PATENT DOCUMENTS

JP 2008164760 A 7/2008
JP 2012173556 A 9/2012
JP 2013041084 A 2/2013

OTHER PUBLICATIONS

International Search Report issued in Intl. Appln. No. PCT/JP2018/011403 dated Jun. 12, 2018. English translation provided.

(Continued)

*Primary Examiner* — Robert W Horn
(74) *Attorney, Agent, or Firm* — Rossi, Kimms & McDowell LLP

(57) ABSTRACT

A pivot member includes: a first member configured to pivot about a pivot axis; and a second member having a connecting surface, at least a portion of which has a flat surface. The second member is disposed such that the flat surface and the first member are opposed to each other. The second member has at least one surface different from the flat surface. A first identifier and a second identifier are provided on the at least one surface. The first identifier is visually recognizable from a first direction orthogonal to the flat surface. The second identifier is visually recognizable from the first direction and from a second direction in which the first identifier is not visually recognizable.

21 Claims, 20 Drawing Sheets

(56) References Cited

U.S. PATENT DOCUMENTS 4,531,443 A * 7/1985 Gillis, Jr. ..... G10D 13/12 84/329
4,667,563 A * 5/1987 Wakuda ..... G10H 1/344 84/433
D319,836 S * 9/1991 Clouse ..... 84/329
5,117,724 A * 6/1992 Gardner ..... G10D 13/12 84/421
5,199,621 A * 4/1993 McLennan ..... A45F 5/00 224/673
5,370,288 A * 12/1994 Field ..... A45C 13/02 211/60.1
5,435,220 A * 7/1995 Pultz ..... G10D 13/12 84/329
5,546,843 A * 8/1996 Degaard ..... G09B 15/006 84/478
5,967,391 A * 10/1999 Hunt ..... A01M 31/004 224/222
6,284,961 B1 * 9/2001 Kimmel, Jr. ..... G09B 15/026 84/478
6,653,542 B2 * 11/2003 Suzuki ..... G10C 3/12 84/423 R
7,164,074 B1 * 1/2007 Graham ..... G10D 13/12 84/421
D570,096 S * 6/2008 VanderPal ..... G10D 13/12 D3/204
7,550,659 B2 * 6/2009 Shimoda ..... G10C 3/12 84/251
7,601,903 B1 * 10/2009 Monk ..... G10D 13/12 84/422.4
7,687,699 B2 * 3/2010 Briggs ..... G10D 13/12 84/422.4
D614,860 S * 5/2010 Sikora ..... D3/204
7,750,222 B2 * 7/2010 Osuga ..... G10C 3/12 84/423 R
7,795,548 B2 * 9/2010 Woods ..... G01G 19/56 177/131
8,076,563 B2 * 12/2011 Kamimura ..... G10C 3/12 84/423 R
8,080,721 B2 * 12/2011 Shimoda ..... G10C 3/12 84/423 R
8,287,338 B2 * 10/2012 Kim ..... A63H 33/006 463/1
8,766,075 B2 * 7/2014 Ishida ..... G10C 1/34 84/423 R
D715,851 S * 10/2014 Chambers ..... D17/99
8,878,039 B2 * 11/2014 Chambers ..... G01D 13/02 84/453
8,969,698 B1 * 3/2015 Suzuki ..... G10C 3/12 84/436
9,177,535 B2 * 11/2015 Suzuki ..... G10C 3/18
9,290,302 B2 * 3/2016 Horn ..... A61J 7/0481
9,384,715 B2 * 7/2016 Taniguchi ..... G10C 3/18
9,495,940 B2 * 11/2016 Hoshino ..... G10C 3/18
D779,812 S * 2/2017 Cohen ..... D3/204
9,564,113 B2 * 2/2017 Bradfield ..... G10G 7/00
9,567,134 B1 * 2/2017 Graves ..... B65D 25/00
10,046,594 B1 * 8/2018 Ferry ..... G09F 23/0066
10,062,364 B1 * 8/2018 Amaral ..... A45F 5/00
10,071,285 B2 * 9/2018 Smith ..... A63B 21/0726
10,115,382 B2 * 10/2018 Nishimura ..... G10C 3/12
2004/0187370 A1 * 9/2004 Buzby ..... G09F 23/00 40/324
2006/0075910 A1 * 4/2006 Cao ..... B41M 7/0027 101/129
2006/0168765 A1 * 8/2006 Beatty ..... A45F 5/02 24/3.13
2008/0307944 A1 * 12/2008 Watanabe ..... G10C 3/12 84/433
2015/0302837 A1 * 10/2015 Massimo ..... G10G 5/00 206/314
2016/0245610 A1 * 8/2016 Schulz ..... F41A 9/65
2017/0112299 A1 * 4/2017 Jones ..... A47G 9/0223
2018/0288887 A1 * 10/2018 Okahata ..... G06F 1/1626
2018/0293591 A1 * 10/2018 Spears ..... B29C 64/386
2019/0392801 A1 * 12/2019 Takahashi ..... G10H 1/344
2020/0013378 A1 * 1/2020 Takahashi ..... B41J 5/10
2020/0118529 A1 * 4/2020 Shahinian ..... G10D 13/12

OTHER PUBLICATIONS

Written Opinion issued in Intl. Appln. No. PCT/JP2018/011403 dated Jun. 12, 2018. English translation provided.
International Preliminary Report on Patentability issued in Intl. Appln. No. PCT/JP2018/011403 dated Oct. 3, 2019. English translation provided.

* cited by examiner

230wl

230wh

230b

PIVOT MEMBER AND KEYBOARD APPARATUS

CROSS REFERENCE TO RELATED APPLICATION

The present application is a continuation application of International Application No. PCT/JP2018/011403, filed on Mar. 22, 2018, which claims priority to Japanese Patent Application No. 2017-060138, filed on Mar. 24, 2017. The contents of these applications are incorporated herein by in their entirety.

BACKGROUND

The present disclosure relates to a pivot member. The present disclosure also relates to a keyboard apparatus including the pivot member.

Keyboard instruments are constituted by a lot of components, resulting in a very complicated action mechanism for the components corresponding to pressing and releasing of each key. The action mechanism includes a pivot mechanism with which a lot of components are pivotably engaged.

For example, an action mechanism of an electronic keyboard instrument includes a pivot member interlocked with a key in order to simulate and give a feeling of an acoustic piano to a player via the key. Corresponding to a similar structure in an acoustic piano, this structure is usually expressed as a hammer, but the structure does not have a function of striking a string because no string is provided in the electronic keyboard instrument. In response to pressing of the key, the hammer of the electronic keyboard instrument pivots with respect to a frame so as to raise a weight provided for the hammer. The weights provided for the respective hammers respectively have different masses for the respective keys. In the electric keyboard apparatus, the mass of the weight is designed to decrease stepwise from a low-pitched sound portion toward a high-pitched sound portion, thereby reproducing touch feeling of the acoustic piano.

However, a difference in the mass of the weight is small between the hammers corresponding to close pitches, making it difficult to identify the weight corresponding to each key. This leads to lower productivity and inspection efficiency of the keyboard apparatus. For example, Patent Document 1 (Japanese Patent Application Publication No. 2012-173556) discloses providing identifiers on hammers, hammer supporters, and keys to indicate their respective pitches.

SUMMARY

Patent Document 1 discloses providing an identifier at a position visually recognizable from above in any phase before and after a hammer is assembled. However, this position is not visually recognizable in a state in which a plurality of keys are assembled to a support member.

Accordingly, an aspect of the disclosure relates to a technique for improving the productivity and the inspection efficiency of a pivot member and a keyboard apparatus of an electronic musical instrument including the pivot member, by making it easy to recognize the type of the pivot member from a plurality of directions.

A pivot member according to the present disclosure includes: a first member configured to pivot about a pivot axis; and a second member having a connecting surface, at least a portion of which has a flat surface, the second member being disposed such that the flat surface and the first member are opposed to each other, the second member having at least one surface different from the flat surface, a first identifier and a second identifier being provided on the at least one surface, the first identifier being visually recognizable from a first direction orthogonal to the flat surface, the second identifier being visually recognizable from the first direction and from a second direction in which the first identifier is not visually recognizable.

A keyboard apparatus according to the present disclosure includes: a frame; a plurality of keys pivotably disposed on the frame; and a plurality of pivot members, each as the pivot member, arranged respectively corresponding to the plurality of keys. A position of the pivot axis with respect to the frame is fixed. Each of the plurality of pivot members respectively corresponding to the plurality of keys pivots in response to pivotal movement of a corresponding one of the plurality of keys.

A pivot member according to the present disclosure is for an action mechanism of a keyboard instrument. A plurality of pivot members each as the pivot member is provided corresponding respectively to a plurality of keys in a keyboard apparatus and arranged in a pivot-axis direction. The pivot member has a connecting surface, at least a portion of which has a flat surface. The flat surface and a first member are disposed so as to be opposed to each other. The pivot member further has at least one surface different from the flat surface. A first identifier and a second identifier are provided on the at least one surface. The first identifier is visually recognizable from the pivot-axis direction. The second identifier is visually recognizable from the pivot-axis direction and a direction orthogonal to the pivot-axis direction.

A pivot member according to the present disclosure is for an action mechanism of a keyboard instrument. A plurality of pivot members each as the pivot member are provided corresponding respectively to a plurality of keys in a keyboard apparatus and arranged in a pivot-axis direction. The pivot member includes a first identifier and a second identifier. The first identifier is visually recognizable from the pivot-axis direction. The second identifier is visually recognizable from the pivot-axis direction and a direction orthogonal to the pivot-axis direction.

BRIEF DESCRIPTION OF THE DRAWINGS

The objects, features, advantages, and technical and industrial significance of the present disclosure will be better understood by reading the following detailed description of the embodiment, when considered in connection with the accompanying drawings, in which.

THE EMBODIMENT FOR CARRYING OUT THE INVENTION

Figure 1:
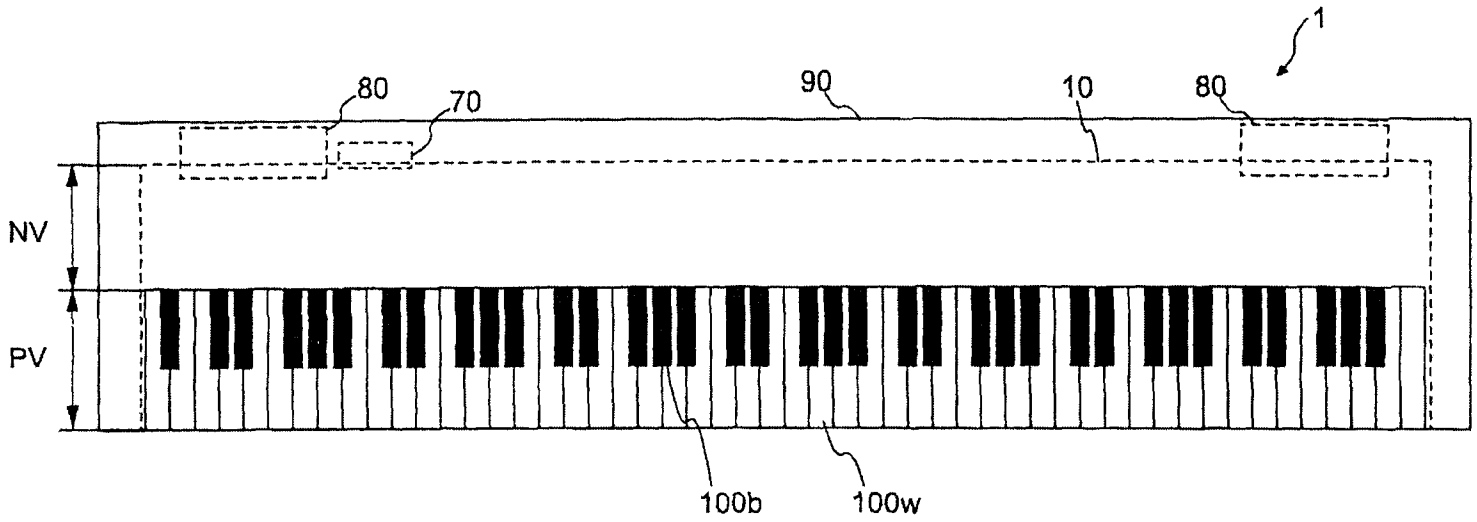
FIG. 1 is a view of a configuration of a keyboard apparatus in one embodiment.

Hereinafter, there will be described one embodiment of the present disclosure by reference to the drawings. It is to be understood that the following embodiment of the present disclosure is described by way of example, and the present disclosure should not be construed as limited to this embodiment. It is noted that the same or similar reference numerals (e.g., numbers with a character, such as A or B, appended thereto) may be used for components having the same or similar function in the following description and drawings, and an explanation of which may be dispensed with. The ratio of dimensions in the drawings (e.g., the ratio between the components and the ratio in the lengthwise, widthwise, and height directions) may differ from the actual ratio, and portions of components may be omitted from the drawings for easier understanding purposes.

Configuration of Keyboard Apparatus

FIG. 1 is a view of a configuration of a keyboard apparatus according to one embodiment as a first embodiment. In the present example, a keyboard apparatus 1 is an electronic keyboard instrument, such as an electronic piano, configured to produce a sound when a key is pressed by a user (a player). It is noted that the keyboard apparatus 1 may be a keyboard-type controller configured to output data (e.g., MIDI) for controlling an external sound source device, in response to key pressing. In this case, the keyboard apparatus 1 may include no sound source device.

The keyboard apparatus 1 includes a keyboard assembly 10. The keyboard assembly 10 includes white keys 100*w* and black keys 100*b*. The white keys 100*w* and the black keys 100*b* are arranged side by side. The number of the keys 100 is N and 88 in this example. The number of the keys 100 is not limited to this number. A direction in which the keys 100 are arranged will be referred to as "scale direction". The white keys 100*w* and the black keys 100*b* may be hereinafter collectively referred to "the key 100" in the case where there is no need of distinction between the white keys 100*w* and the black keys 100*b*. Also in the following explanation, "w" appended to the reference number indicates a configuration corresponding to the white key. Also, "b" appended to the reference number indicates a configuration corresponding to the black key.

Here, the directions to be used in the following description (the scale direction D1 and the pivotal direction D2) will be defined. The scale direction D1 is a direction in which the keys 100 are arranged. The pivotal direction D2 corresponds to a direction in which the key pivots about a direction in which each of hammer assemblies 200 extends (i.e., a back direction when viewed by the player and a direction reverse to the D3 direction). It is noted that the pivotal direction D2 of the hammer assemblies 200 substantially coincides with the pivotal direction of the key 100.

A portion of the keyboard assembly 10 is located in a housing 90. In the case where the keyboard apparatus 1 is viewed from an upper side thereof, a portion of the keyboard assembly 10 which is covered with the housing 90 will be referred to as "non-visible portion NV", and a portion of the keyboard assembly 10 which is exposed from the housing 90 and viewable by the user will be referred to as "visible portion PV". That is, the visible portion PV is a portion of the key 100 which is operable by the user to play the keyboard apparatus 1. A portion of the key 100 which is exposed by the visible portion PV may be hereinafter referred to as "key main body portion".

The housing 90 contains a sound source device 70 and a speaker 80. The sound source device 70 is configured to create a sound waveform signal in response to pressing of the key 100. The speaker 80 is configured to output the sound waveform signal created by the sound source device 70, to an outside space. It is noted that the keyboard apparatus 1 may include: a slider for controlling a sound volume; a switch for changing a tone color; and a display configured to display various kinds of information.

In the following description, up, down, left, right, front, and back (rear) directions respectively indicate directions in the case where the keyboard apparatus 1 is viewed from the player during playing. Thus, it is possible to express that the non-visible portion NV is located on a back side of the visible portion PV, for example. Also, directions may be represented with reference to the key 100. For example, a key-front-end side (a key-front side) and a key-back-end side (a key-back side) may be used. In this case, the key-front-end side is a front side of the key 100 when viewed from the player. The key-back-end side is a back side of the key 100 when viewed from the player. According to this definition, it is possible to express that a portion of the black key 100*b* from a front end to a rear end of the key main body portion of the black key 100*b* is located on an upper side of the white key 100*w*.

Figure 2:
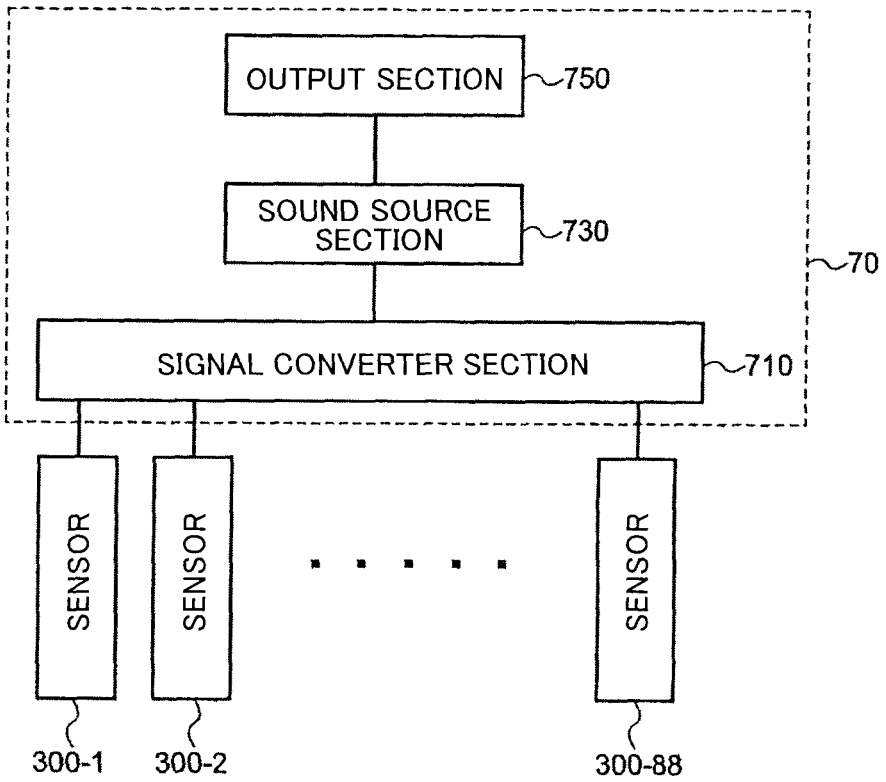
FIG. 2 is a block diagram illustrating a configuration of a sound source device in the one embodiment.

FIG. 2 is a block diagram illustrating the configuration of the sound source device in the one embodiment. The sound source device 70 includes a signal converter section 710, a sound source section 730, and an output section 750. Sensors 300 are provided corresponding to the respective keys 100. Each of the sensors 300 detects an operation of a corresponding one of the keys 100 and outputs signals in accordance with the detection. In the present example, each of the sensors 300 outputs signals in accordance with three levels of key pressing amounts. The speed of the key pressing is detectable in accordance with a time interval between the signals.

The signal converter section 710 obtains the signals output from the sensors 300 (the sensors 300-1, 300-2, . . . , 300-88 corresponding to the respective 88 keys 100) and creates and outputs an operation signal in accordance with an operation state of each of the keys 100. In the present example, the operation signal is a MIDI signal. Thus, the signal converter section 710 outputs "Note-On" when a key is pressed. In this output, a key number indicating which one of the 88 keys 100 is operated, and a velocity corresponding to the speed of the key pressing are also output in association with "Note-On". When the player has released the key 100, the signal converter section 710 outputs the key number and "Note-Off" in association with each other. A signal created in response to another operation, such as an operation on a pedal, may be output to the signal converter section 710 and reflected on the operation signal.

The sound source section 730 creates the sound waveform signal based on the operation signal output from the signal converter section 710. The output section 750 outputs the sound waveform signal created by the sound source section 730. This sound waveform signal is output to the speaker 80 or a sound-waveform-signal output terminal, for example.

Configuration of Keyboard Assembly

Figure 3:
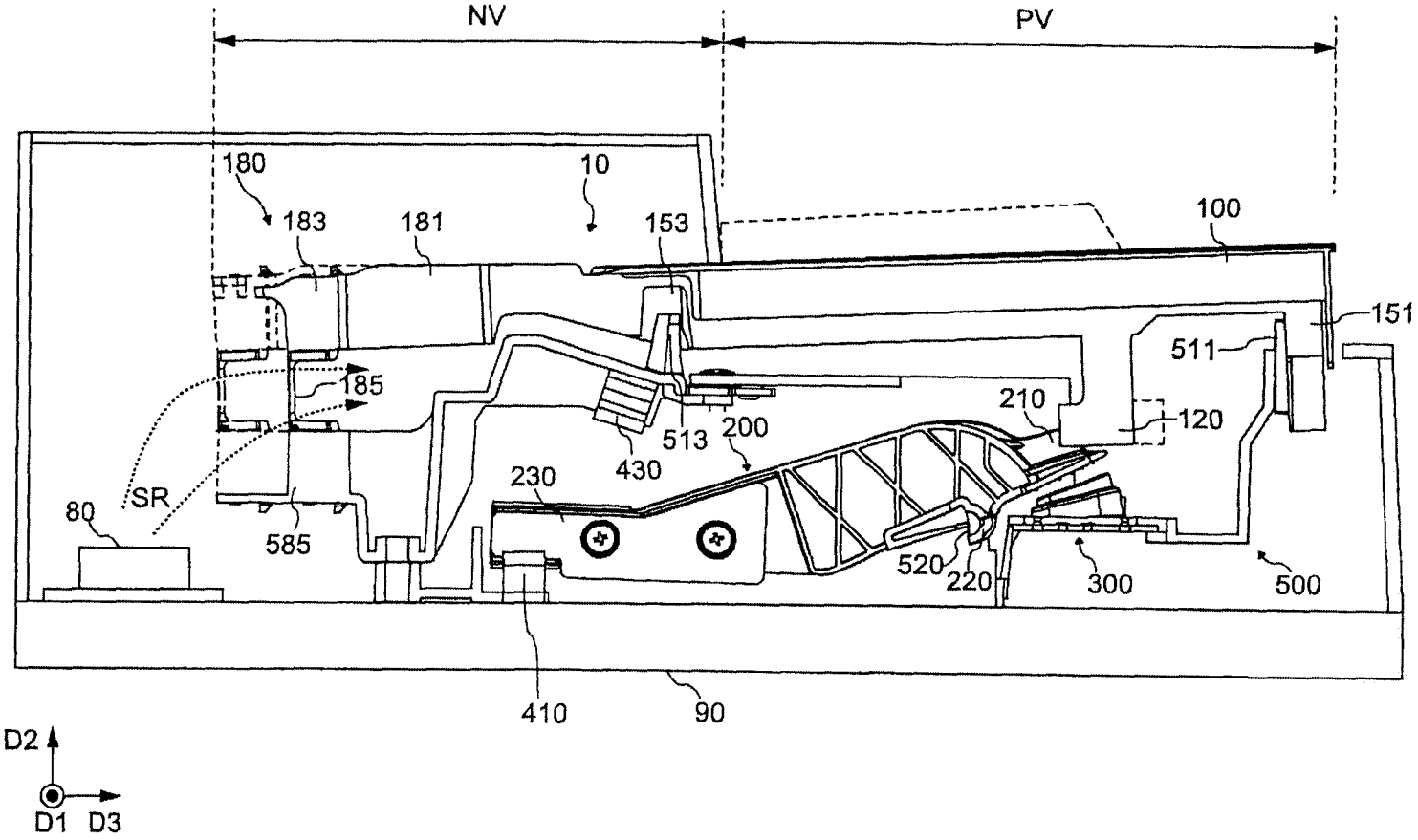
FIG. 3 is a view for explaining a configuration of the inside of a housing in the one embodiment, with the configuration viewed in a scale direction.

FIG. 3 is a view of a configuration of the inside of the housing in the one embodiment, with the configuration viewed in the scale direction. As illustrated in FIG. 3, the keyboard assembly 10 and the speaker 80 are disposed in the housing 90. That is, the housing 90 covers at least a portion of the keyboard assembly 10 (connecting portions 180 and a frame 500) and the speaker 80. The speaker 80 is disposed at a back portion of the keyboard assembly 10. This speaker 80 is disposed so as to output a sound, which is produced in response to pressing of the key 100, toward upper and lower sides of the housing 90. The sound output downward travels toward the outside from a portion of the housing 90 near its lower surface. The sound output upward passes from the inside of the housing 90 through a space in the keyboard assembly 10 and travels to the outside from a space between the housing 90 and the keys 100 or from spaces each located between adjacent two of the keys 100 at the visible portion PV. It is noted the path of a sound emitted from the speaker 80 is indicated by a path SR. Thus, the sound emitted from the speaker 80 reaches a space defined in the keyboard assembly 10, i.e., a space defined under the keys 100 (the key main body portions).

There will be next described a configuration of the keyboard assembly 10 with reference to FIG. 3. In addition to the keys 100, the keyboard assembly 10 includes the connecting portions 180, the hammer assemblies 200, and the frame 500. While the key 100 of the keyboard assembly 10 is a white key (indicated by the solid lines) in FIG. 3, the black key (indicated by the broken lines) has a configuration similar to that of the white key. The keyboard assembly 10 is formed of resin, and a most portion of the keyboard assembly 10 is manufactured by, e.g., injection molding. The frame 500 is fixed to the housing 90. The connecting portions 180 connect the respective keys 100 to the frame 500 such that the keys 100 are pivotable. Each of the connecting portions 180 includes a plate-like flexible member 181, a key-side supporter 183, and a rod-like flexible member 185. The plate-like flexible member 181 extends from a rear end of the key 100. The key-side supporter 183 extends from a rear end of the plate-like flexible member 181.

Each of the rod-like flexible members 185 is supported by a corresponding one of the key-side supporters 183 and a frame-side supporter 585 of the frame 500. The key 100 pivots with respect to the frame 500 about the rod-like flexible member 185. The rod-like flexible members 185 is attachable to and detachable from the key-side supporters 183 and the frame-side supporter 585. This attachable and detachable configuration of the rod-like flexible member 185 improves easiness of manufacturing (e.g., facilitation of design of a metal mold, facilitation of assembly, and facilitation of repair) and improves touch feeling and the strength made by combination of materials, for example. It is noted that the rod-like flexible members 185 may be integral with the key-side supporters 183 and the frame-side supporter 585 or bonded thereto so as not to be attached or detached, for example.

The key 100 includes a front-end key guide 151 and a side-surface key guide 153. The front-end key guide 151 is in slidable contact with a front-end frame guide 511 of the frame 500 in a state in which the front-end key guide 151 covers the front-end frame guide 511. The front-end key guide 151 is in contact with the front-end frame guide 511 at opposite side portions of upper and lower portions of the front-end key guide 151 in the scale direction. The side-surface key guide 153 is in slidable contact with a side-surface frame guide 513 at opposite side portions of the side-surface key guide 153 in the scale direction. In the present example, the side-surface key guide 153 is disposed at portions of side surfaces of the key 100 which correspond to the non-visible portion NV, and the side-surface key guide 153 is nearer to the front end of the key 100 than the connecting portion 180 (the plate-like flexible member 181), but the side-surface key guide 153 may be disposed at a region corresponding to the visible portion PV.

A hammer supporter 120 is connected to the key 100 at a lower part of the visible portion PV. The hammer supporter is connected to the hammer assembly 200 so as to cause pivotal movement of the hammer assembly 200 while the key 100 is pivoting.

Each of the hammer assemblies 200 is disposed under a space defined under a corresponding one of the keys 100 and is pivotably attached to the frame 500. A pivot shaft 520 of the frame 500 to which the hammer assemblies 200 is attached extends in the scale direction. That is, the hammer assemblies 200 are arranged in the scale direction so as to correspond to the keys 100. The hammer assembly 200 includes a weight 230 and a hammer body portion 205. A bearing 220 is disposed on the hammer body portion 205. The bearing 220 and the pivot shaft 520 of the frame 500 are in slidable contact with each other at at least three points. That is, each of the hammer assemblies 200 is pivotable about the pivot shaft 520 of the frame 500 (the central axis of the pivot shaft 520). A front end portion 210 of the hammer assembly 200 is connected to the key 100 in an inner space of the hammer supporter 120 so as to be slidable substantially in the front and rear direction. This sliding portion, i.e., a load generating portion at which the front end portion 210 and the hammer supporter 120 are in contact with each other, is located under the key 100 at the visible portion PV (located in front of a rear end of the key main body portion). It is noted that the configuration of the load generating portion will be described below.

In the present embodiment, the weight 230 is constituted by a single metal weight. It is noted that the weight may be constituted by a plurality of components. The weight 230 is connected to a rear end portion of the hammer body portion 205 (on a back side of the pivot center). In a normal state (i.e., a state in which the key 100 is not pressed), the weight 230 is placed on a lower stopper 410, and the front end portion 210 of the hammer assembly 200 pushes the key 100 upward. When the key 100 is pressed, the weight 230 moves upward and comes into contact with an upper stopper 430. This defines an end position corresponding to the largest key pressing amount of the key 100. The hammer assembly 200 applies a load to key pressing by the weight 230. The lower stopper 410 and the upper stopper 430 are formed of a cushioning material (such as a nonwoven fabric and a resilient material). It is noted that the detailed configuration of the hammer assembly 200 will be described later.

The sensor 300 is attached to the frame 500 under the hammer supporter 120 and the front end portion 210. When the key 100 is pressed, a lower surface of the front end portion 210 pushes the sensor 300, causing the sensor 300 to output detection signals. As described above, the sensors 300 are provided for the respective keys 100.

Overview of Load Generating Portion

Figure 4:
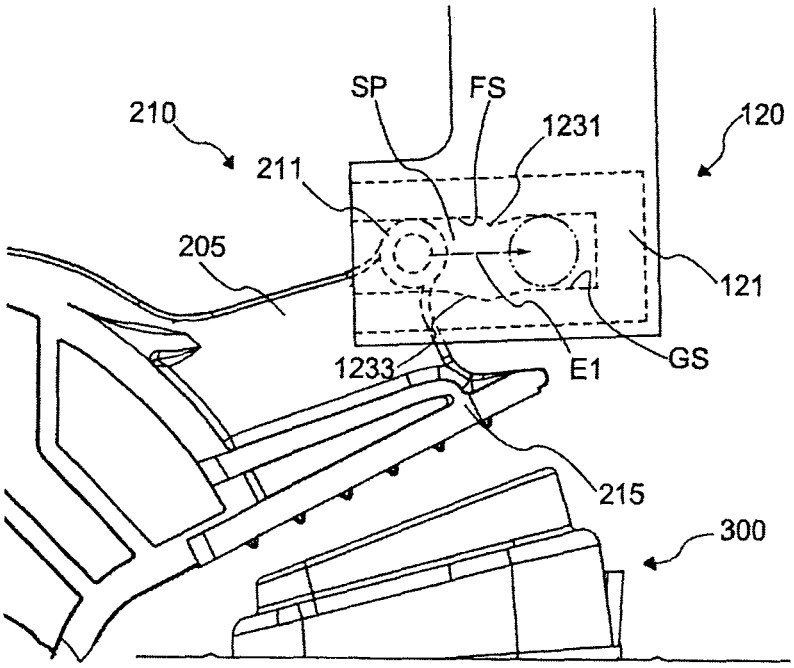
FIG. 4 is a view for explaining a configuration of a load generating portion of a keyboard assembly in the one embodiment, with the configuration viewed in the scale direction.

FIG. 4 is a view for explaining the load generating portion (the hammer supporter and the front end portion). The front end portion 210 of the hammer assembly 200 includes a force-applied portion 211 and a pressing portion 215. These components are connected to the hammer body portion 205. The hammer body portion 205 has a plate shape in this example. The force-applied portion 211 having a substantially circular cylindrical shape protrudes in a direction substantially perpendicular to the hammer body portion 205. The force-applied portion 211 is disposed in an inner space SP of the hammer supporter 120 so as to be parallel with the pivot shaft 520 of the frame 500 (the scale direction). That is, the hammer body portion 205 having the plate shape is disposed so as not to be parallel with a pivot plane but to be slightly inclined with respect to the pivot plane, to which normal coincides with the direction in which the pivot shaft 520 extends. The pressing portion 215 is provided under the front end portion 210 and has a surface with respect to the pivotal direction so as to increase the thickness of the plate shape. When the key is pressed, the pressing portion 215 is brought into contact with the sensor 300 at a position near the lower surface of the front end portion 210.

The hammer supporter 120 includes a sliding-surface forming portion 121. In this example, the sliding-surface forming portion 121 forms a space SP therein in which the force-applied portion 211 is movable. A sliding surface FS defines the upper side of the space SP, and a guide surface GS defines the lower side of the space SP. The guide surface GS has a slit through which the hammer body portion 205 passes. A region in which at least the sliding surface FS is constituted by an elastic member formed of rubber. In this example, the entire sliding-surface forming portion 121 is formed of an elastic material.

FIG. 4 illustrates the position of the force-applied portion 211 in the case where the key 100 is located at a rest position. When the key is pressed, the force-applied portion 211 is moved in the space SP in a direction indicated by arrow E1 (which may be hereinafter referred to as "travel direction E1"), while contacting the sliding surface FS. That is, the force-applied portion 211 is slid on the sliding surface FS. In this example, the sliding surface FS has a step portion 1231 formed in a region at which the force-applied portion 211 is moved by pivotal movement of the key 100 from the rest position to the end position. That is, the force-applied portion 211 moved from its initial position (the position of the force-applied portion 211 when the key 100 is located at the rest position) is moved over the step portion 1231. A recessed portion 1233 is formed at a portion of the guide surface GS which is opposed to the step portion 1231. The recessed portion 1233 makes it easy for the force-applied portion 211 to move over the step portion 1231.

When the key is pressed, a force is applied from the sliding surface FS to the force-applied portion 211. The force transmitted to the force-applied portion 211 causes pivotal movement of the hammer assembly 200 so as to move the weight 230 upward. In this movement, the force-applied portion 211 is pressed against the sliding surface FS. When the key is released, the weight 230 falls down to cause pivotal movement of the hammer assembly 200. As a result, a force is applied from the force-applied portion 211 to the sliding surface FS. Here, the force-applied portion 211 is formed of a material which causes elastic deformation less easily when compared with the material of the elastic member forming the sliding surface FS (noted that one example of the material is resin having high stiffness). Thus, when the force-applied portion 211 is pressed against the sliding surface FS, the sliding surface FS is deformed elastically. As a result, the force-applied portion 211 receives various resistance forces against movement in accordance with the pressing force.

Configuration of Hammer Assembly

Figure 5A:
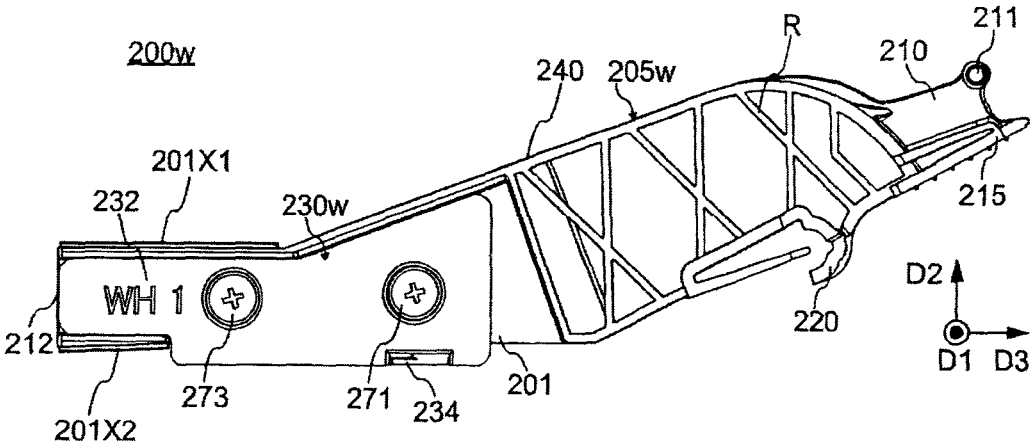
FIGS. 5A through 5C are views for explaining a detailed configuration of a hammer assembly corresponding to a white key in the one embodiment.
Figure 5B:
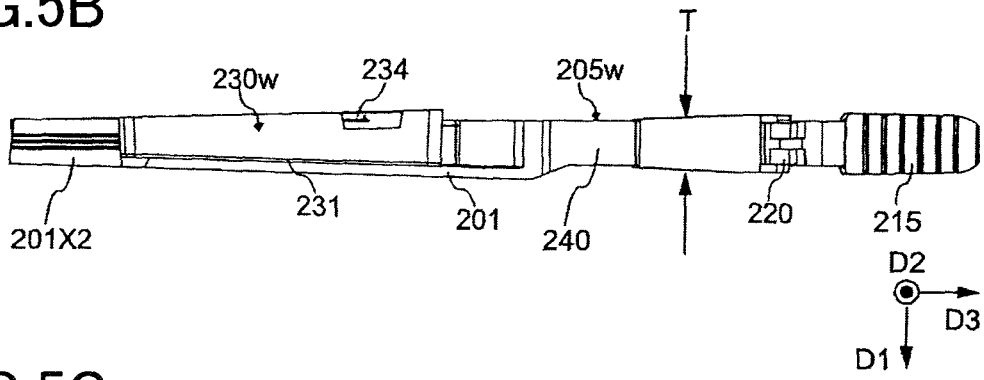
Figure 5C:
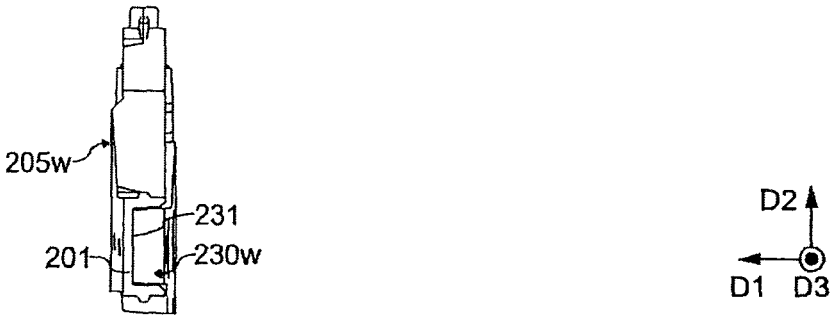

FIGS. 5A-5C are views for explaining the hammer assembly corresponding to the white key in the one embodiment. FIG. 5A is a view of the hammer assembly viewed in the scale direction (the direction in which the pivot shaft extends and the D1 direction in FIG. 3). FIG. 5B is a view of the hammer assembly viewed from a lower-surface side in the pivotal direction (the D2 direction in FIG. 3). FIG. 5C is a view of the hammer assembly viewed from a back side (a key-back-end side) in the direction in which the hammer assembly extends (the D3 direction in FIG. 3). It is possible to consider that the pivotal direction of the hammer assembly when the hammer assembly 200 pivots about the pivot shaft coincides with a direction (a direction parallel to the pivot plane) contained in a plane, to which normal coincides with the direction in which the pivot shaft extends (the pivot plane and a plane perpendicular to the pivot shaft). In the case where the pivotal direction is defined as described above, one example of the pivotal direction is the pivotal direction D2.

In the following description, while an explanation will be provided for a hammer assembly 200*w* corresponding to the white key, a hammer assembly 200*b* corresponding to the black key has a configuration similar to that of the hammer assembly 200*w*. The hammer assembly 200*w* (as one example of a pivot member) includes a hammer body portion 205*w* (as one example of a first member) and a weight 230*w* (as one example of a second member). The hammer body portion 205*w* includes: the front end portion 210 including the force-applied portion 211 and the pressing portion 215; a rear end portion 212; and a connecting portion 240 connected at its one end to the front end portion 210 and at the other end to the rear end portion 212. The connecting portion 240 has the predetermined thickness T due to a rib R. A portion of the connecting portion 240 includes the bearing 220. The rear end portion 212 includes: a planar plate-like region at at least a weight mount portion 201; a first weight supporting wall 201X1 continued from the connecting portion 240 near an upper surface of the plate-like region in the pivotal direction (the D2 direction in FIG. 3 and one example of the direction orthogonal to the pivot-shaft direction); and a second weight supporting wall 201X2 opposed to the first weight supporting wall 201X1. The second weight supporting wall 201X2 is formed at a position separated from the connecting portion 240 near a rear end of the hammer assembly 200*w* and at a position near a lower surface of the pivot member in the pivotal direction (the D2 direction in FIG. 3). The weight mount portion 201 is disposed at the rear end portion 212. The weight 230 is supported so as to be interposed between the first weight supporting wall 201X1 and the second weight supporting wall 201X2. The second weight supporting wall 201X2 and the connecting portion 240 are spaced apart from each other. Thus, the weight 230 is formed so as to be exposed from between the second weight supporting wall 201X2 and the connecting portion 240 and viewable from a lower-surface side in the pivotal direction (the D2 direction in FIG. 3 and one example of the direction orthogonal to the pivot-shaft direction). That is, the weight 230*w* is assembled to a position near the rear end. However, the present disclosure is not limited to this configuration, and the weight 230*w* at least needs to be disposed in accordance with a configuration of a keyboard to which the present disclosure is applied and at least needs to be disposed at a position nearer to a free end than the pivot center.

The hammer body portion 205*w* and the weight 230*w* are fastened to each other by a plurality of screws in this example. The weight mount portion 201 and the weight 230 are fastened to each other by a first screw 271 located near the pivot center and a second screw 273 far from the pivot center. Here, the number of the screws is not limited to two and may be one or more than two. It is noted that each of the screws is one example of a fastening member, and rivets or other similar components may be used, for example.

The weight 230*w* has at least one planar connecting surface 231 and is mounted on the weight mount portion 201 of the hammer body portion 205*w*. That is, the connecting surface 231 of the weight 230*w* and the weight mount portion 201 of the hammer body portion 205*w* are opposed and connected to each other so as to extend along the first weight supporting wall 201X1 and to be interposed between the first weight supporting wall 201X1 and the second weight supporting wall 201X2. In other words, the connecting surface 231 of the weight 230*w* is disposed along the planar plate-like region of the hammer body portion 205*w*. The weight 230*w* includes a first identifier 232 and a second identifier 234 at a surface of the weight 230*w* which is different from the connecting surface 231 to which the hammer body portion 205*w* is to be connected. Each of the first identifier 232 and the second identifier 234 is identifiable when viewed in the scale direction (the direction in which the pivot axis extends and the D1 direction in FIG. 3). In other words, the first identifier 232 and the second identifier 234 are visually recognizable from a direction orthogonal to the connecting surface 231. The second identifier 234 is identifiable from between the second weight supporting wall 201X2 and the connecting portion when viewed from a lower-surface side in the pivotal direction (the D2 direction in FIG. 3). The first identifier 232 is not identifiable when viewed from a lower-surface side in the pivotal direction (the D2 direction in FIG. 3). In other words, the second identifier 234 is visually recognizable also in a direction orthogonal to the pivot axis in which the first identifier 232 is not visually recognizable (a direction substantially parallel with the connecting surface 231). It is noted that the first identifier 232 and the second identifier 234 will be described later in detail.

In the present embodiment, the hammer body portion 205*w* and the weight 230*w* are different from each other in properties of material. The hammer body portion 205*w* is formed of synthetic resin and manufactured by ejection molding, for example. The weight 230*w* is formed of metal and manufactured by die casting, for example. However, the materials, the manufacturing methods, and so on are not limited to those as long as the specific gravity of the weight 230*w* is greater than that of the hammer body portion 205*w*.

Configuration of Hammer Body Portion

Figure 6A:
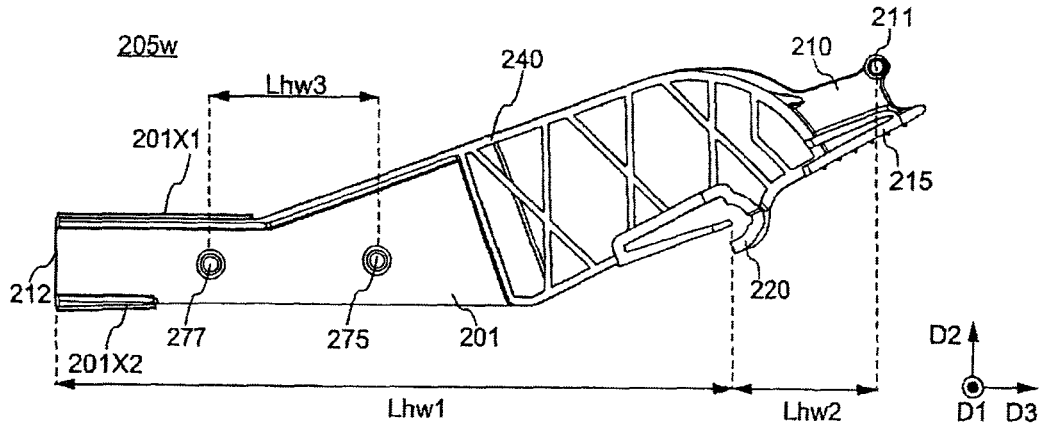
FIGS. 6A and 6B are views for explaining detailed configurations of hammer body portions in the one embodiment.
Figure 6B:
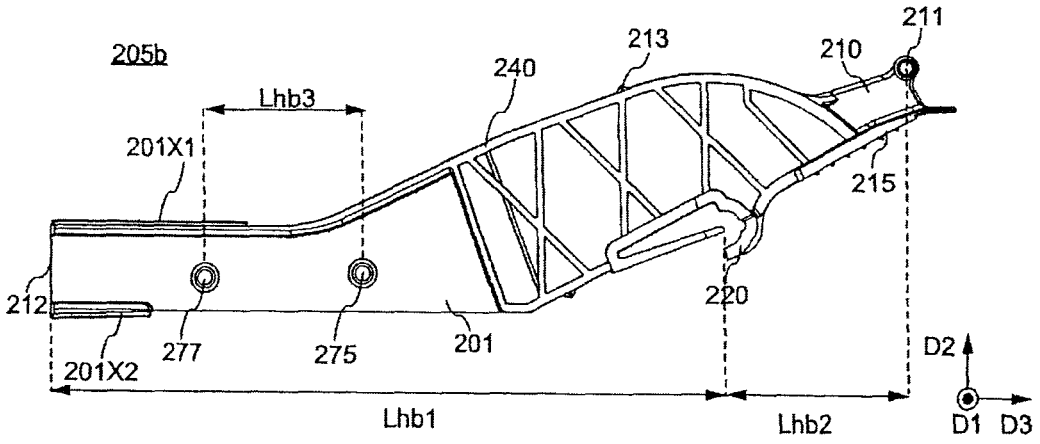

FIGS. 6A and 6B is a view for explaining the hammer body portions in the one embodiment. FIG. 6A is a view of the hammer body portion 205*w* corresponding to the white key which is viewed in the scale direction (the direction in which the pivot shaft extends and the D1 direction in FIG. 3). FIG. 6B is a view of a hammer body portion 205*b* corresponding to the black key which is viewed in the scale direction (the direction in which the pivot shaft extends and the D1 direction in FIG. 3). As illustrated in FIGS. 6A and 6B, the hammer body portion 205 can be classified into at least two types including the hammer body portion 205*w* corresponding to the white key and the hammer body portion 205*b* corresponding to the black key. The distance Lhw1 from the bearing 220 to the rear end portion 212 in the hammer body portion 205*w* corresponding to the white key is equal to the distance Lhb1 from bearing 220 to the rear end portion 212 in the hammer body portion 205*b* corresponding to the black key. The distance Lhb2 from the force-applied portion 211 to the bearing 220 in the hammer body portion 205*b* corresponding to the black key is adjusted so as to be greater than the distance Lhw2 from the force-applied portion 211 to the bearing 220 in the hammer body portion 205*w* corresponding to the white key. That is, the distance (Lhb1+Lhb2) from the force-applied portion 211 to the rear end portion 212 in the hammer body portion 205*b* corresponding to the black key is adjusted so as to be greater than the distance (Lhw1+Lhw2) from the force-applied portion 211 to the rear end portion 212 in the hammer body portion 205*w* corresponding to the white key. In the present embodiment, the number of the hammer body portions 205*w* corresponding to the respective white keys is 52, and the number of the hammer body portions 205*b* corresponding to the respective black keys is 36, but the present disclosure is not limited to these numbers. The hammer body portions 205 are of one type for the white keys and one type for the black keys, but the number of the types of the hammer body portions 205 is not limited to this number. For example, the hammer body portions 205 may be of one type or three or more types.

Since the hammer body portion 205*w* corresponding to the white key and the hammer body portion 205*b* corresponding to the black key are different from each other, the hammer body portion 205*w* and the hammer body portion 205*b* are different from each other in distance between a first screw holder 275 corresponding to the first screw 271 and a second screw holder 277 corresponding to the second screw 273 in order to prevent wrong connection of the weight 230. In this example, the distance Lhb3 from the first screw holder 275 to the second screw holder 277 in the hammer body portion 205*b* corresponding to the black key is adjusted so as to be less than the distance Lhw3 from the first screw holder 275 to the second screw holder 277 in the hammer body portion 205*w* corresponding to the white key.

Screw through holes of the weight 230 which will be described below have a positional relationship similar to the above-described positional relationship. However, the present disclosure is not limited to this configuration. The distance from the first screw holder 275 to the second screw holder 277 may be reversed between the hammer body portion 205*w* corresponding to the white key and the hammer body portion 205*b* corresponding to the black key. The number of the screw holders may be different between the hammer body portion 205*w* corresponding to the white key and the hammer body portion 205*b* corresponding to the black key. Each of the weights 230 corresponding to the respective hammer body portions 205 at least needs to have the screw through holes corresponding to the distance and/or the number of the screw holders. Since the hammer body portion 205 and the weight 230 respectively have the screw holders and the screw through holes corresponding to each combination, it is possible to prevent wrong connection between the hammer body portion 205 and the weight 230, resulting in improved productivity.

A hammer identifier 213 may be provided to easily distinguish between the hammer body portion 205*w* corresponding to the white key and the hammer body portion 205*b* corresponding to the black key. In this example, the hammer identifier 213 having a protruding shape is disposed on an upper surface of the hammer body portion 205*b* corresponding to the black key in the pivotal direction. While the hammer identifier 213 is shaped like a rib protruding from the upper surface in the pivotal direction, the present disclosure is not limited to this shape. The hammer identifier 213 may have any shape as long as pivotal movement of the hammer assembly 200*b* is not limited. Since the hammer identifier 213 is provided, it is possible to easily distinguish between the hammer body portion 205*w* corresponding to the white key and the hammer body portion 205*b* corresponding to the black key. This prevents erroneous identification between the hammer body portions of the two types, resulting in improved productivity.

Configuration of Weight

Figure 7A:
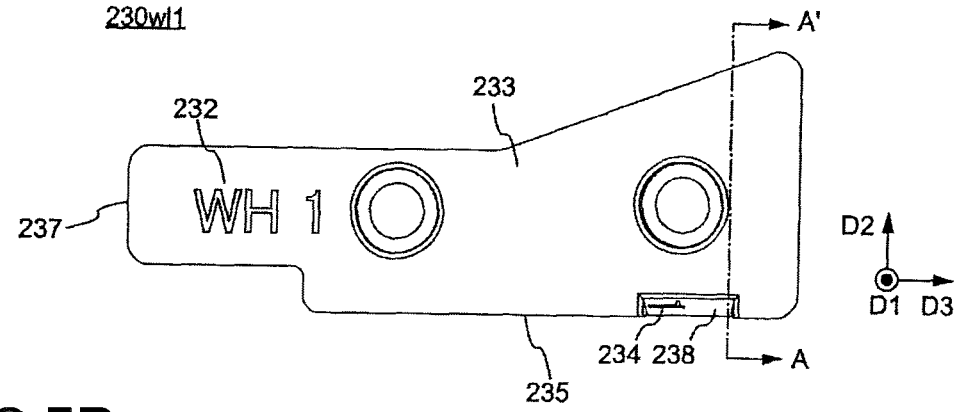
FIGS. 7A through 7D are views for explaining a detailed configuration of a weight in the one embodiment.
Figure 7B:
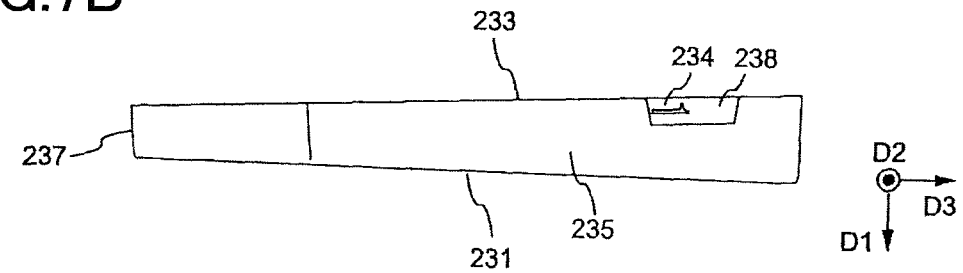
Figure 7C:
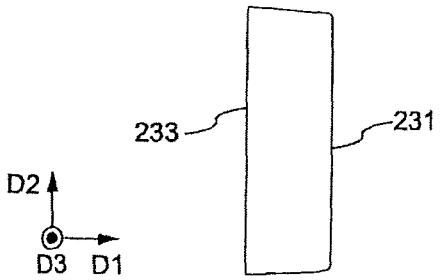
Figure 7D:
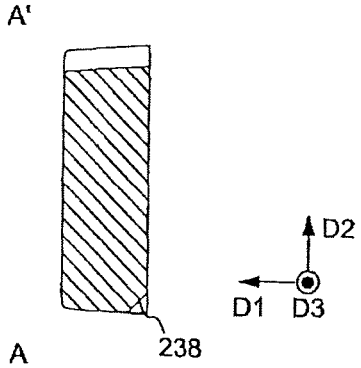

FIGS. 7A-7D are views for explaining the weights in the one embodiment. FIG. 7A is a view of a weight 230*w*11 corresponding to a low-pitched-sound white key which is viewed in the scale direction (the direction in which the pivot shaft extends and the D1 direction in FIG. 3). FIG. 7B is a view of the weight 230*w*11 viewed from a lower-surface side in the pivotal direction of the hammer assembly (the D2 direction in FIG. 3). FIG. 7C is a view of the weight 230*w*11 viewed in the direction in which the hammer assembly extends (the direction from the front side toward the back side when viewed from the player in the state in which the hammer assembly is assembled to the keyboard apparatus, and the direction reverse to the D3 direction in FIG. 3). FIG. 7D is a cross-sectional view taken along line A-A', illustrating a weight 230*w*1 corresponding to a low-pitched-sound-side first white key which is viewed in the direction in which the hammer assembly 200 extends (the direction from the back side toward the front side when viewed from the player in the state in which the hammer assembly is assembled to the keyboard apparatus, and the D3 direction in FIG. 3).

Each of the weights 230 includes the first identifier 232 and the second identifier 234 for easy identification of the weight 230 corresponding to the corresponding one of the keys. The weight 230 includes the first identifier 232 on a surface 233 of the weight 230 which is opposed to the connecting surface 231 to which the hammer body portion 205 is connected. As illustrated in FIGS. 5A-5C, the connecting surface 231 and the surface 233 are two surfaces having the largest areas among a plurality of surfaces forming the outer shape of the weight 230 as a plate-like member (the surface having the largest area and the surface having the second largest area among the plurality of surfaces). In a state in which the weight 230 is mounted on the weight mount portion 201 of the hammer body portion 205, the surface 233 on which the first identifier 232 is provided is located farther from the weight mount portion 201 than the connecting surface 231. The connecting surface 231 and the surface 233 are two surfaces having the largest areas when the weight 230 is viewed in the direction in which the pivot axis extends, among the plurality of surfaces forming the outer shape of the weight 230. The connecting surface 231 is mounted on the weight mount portion 201 of the hammer body portion 205 among the two surfaces, namely, the connecting surface 231 and the surface 233. Thus, in the state in which the weight 230 is mounted on the weight mount portion 201, a most portion of the connecting surface 231 is covered with the weight mount portion 201 when viewed in the direction of assembly of the weight 230 to the hammer body portion 205 (the direction in which the rotation axis extends). The surface 233 is not covered with the weight mount portion 201 when viewed in the direction of the assembly of the weight 230 to the hammer body portion 205. That is, in the state in which the weight 230 is mounted on the weight mount portion 201 and before the hammer assembly 200 constituted by the weight 230 and the hammer body portion 205 is attached to the frame 500 (the keyboard assembly 10), the area of a portion of the surface 233 which is covered with the weight mount portion 201 is less than that of a portion of the connecting surface 231 which is covered with the weight mount portion 201 when viewed in the direction of the assembly of the weight 230 to the hammer body portion 205. Thus, when viewed in the direction of the assembly of the weight 230 to the hammer body portion 205 (the direction in which the pivot axis extends, the D1 direction in FIG. 3, and one example of a first direction), the first identifier 232 is identifiable (visually recognizable) not only in the case of the weight 230 alone but also in the case where the weight 230 is assembled to the hammer body portion 205. In other words, the first identifier 232 is visually recognizable in the direction orthogonal to the connecting surface 231. Since the surface 233 is larger in size than a surface 238 which will be described below, it is possible to make the first identifier 232 larger than the second identifier 234. Since the first identifier 232 is larger than the second identifier 234, when the weight 230 is assembled to the hammer body portion 205 and when the hammer assembly 200 is assembled to the keyboard apparatus, the first identifier 232 is easily viewed, resulting in improved productivity. However, the present disclosure is not limited to this configuration. For example, the first identifier 232 may have the same size as that of the second identifier 234 and may be smaller in size than the second identifier 234.

The first identifier 232 has information about any of two types of the key, i.e., the white key (WH) or the black key (BL). In other words, the first identifier 232 has information about the hammer body portion 205 corresponding to any of two types of the key, i.e., the white key or the black key. That is, the first identifier 232 has information indicating the weight 230 corresponding to the white key (as one example of a first-group first member) or information indicating the weight 230 corresponding to the black key (as one example of a second-group first member), and the first identifier 232 distinguishes between the weight 230 corresponding to the white key and the weight 230 corresponding to the black key. In this example, "WH" is written on the weight 230*w* corresponding to the white key. "BL" is written on a weight 230*b* corresponding to the black key. However, the present disclosure is not limited to this configuration. The first identifier 232 at least needs to indicate information about any of two types of the hammer body portion 205. Other letters, signs, or a color may be provided instead of "WH" and "BL". Since the first identifier 232 having this information is provided on the surface 233 opposed to the connecting surface 231, the weight 230 is easily identifiable when the weight 230 is connected to the hammer body portion 205. This prevents misidentification of the weight 230, thereby improving the productivity in combination of the weight 230 and the hammer body portion 205.

The first identifier 232 further has positional information about the weight 230 corresponding to each key in the white keys (WH) or the black keys (BL). In other words, the first identifier 232 has information about the arrangement ordinal number of the hammer assembly 200 corresponding to each key in each of the two types of the hammer body portions which correspond respectively to the white key and the black key. In this example, the numbers are assigned in order of pitch from a low-pitched sound portion toward a high-pitched sound portion for the white keys and the black keys separately. However, the present disclosure is not limited to this configuration, letters, signs, or colors having ordinal concept may be provided on the first identifiers 232 instead of numbers. The position at which the first identifier 232 is provided may be different among the weights 230 as long as the positional relationship between the first identifier 232 and the second identifier 234 which will be described below is satisfied. Thus, the first identifier 232 may indicate information at the position at which the first identifier 232 is provided. Since the first identifier 232 having this information is provided on the surface 233 opposed to the connecting surface 231, the weight 230 is easily identifiable even after the weight 230 is connected to the hammer body portion 205. This prevents misidentification of the weights 230 or the hammer assemblies 200, thereby improving management of the eighty-eight types of the weights 230 or the hammer assemblies 200. Also, it is possible to improve the productivity when the eighty-eight types of the hammer assemblies 200 are assembled to the keyboard assembly 10. While the eighty-eight types of the hammer assemblies are provided, the number of the hammer assemblies is not limited to this number. For example, the hammer assemblies may be common in each octave to provide eight types or four types of the hammer assemblies, and the number of the types of the hammer assemblies may be related to another classification of a key range. In this case, an identifier indicating a key range is used as identification information.

After the plurality of the hammer assemblies 200 are assembled to the keyboard assembly 10, the hammer assemblies 200 are provided next to each other in the direction in which the weight 230 is assembled. Thus, when the hammer assemblies 200 are arranged at the same position when viewed in the scale direction, it is difficult to identify the first identifier 232 provided on the hammer assembly 200 located on a back side. The surface 233 having the first identifier 232 is opposed to the connecting surface 231 of the weight 230 of the adjacent hammer assembly 200. Since the hammer assemblies 200 adjacent to each other are close to each other, it is difficult to identify the first identifier 232 on only one of the weights 230 located respectively on the highest-pitched-sound side and the lowest-pitched-sound side of the keyboard assembly 10, on which the surface 233 opposed to the connecting surface 231 is exposed.

The weight 230 includes the second identifier 234 on the surface 238 that connects between a surface 235 continuing to the connecting surface 231 and the surface 233 opposed to the connecting surface 231. As illustrated in FIGS. 7A-7D, in this example, the weight 230 is a plate-like member. The surface 238 is a surface formed by cutting a corner defined by the surface 233 having the first identifier 232 and the surface 235 continuing to the connecting surface 231. Thus, the surface 238 continues to the surface 233 and the surface 235. The second identifier 234 is identifiable when viewed in the direction of the assembly of the weight 230 to the hammer body portion 205 (the direction in which the pivot axis extends and the D1 direction in FIG. 3). In other words, the second identifier 234 is visually recognizable in the direction orthogonal to the connecting surface 231. The second identifier 234 is also identifiable when viewed from a lower-surface side in the pivotal direction (the D2 direction in FIG. 3 and one example of a second direction). The first identifier 232 is not identifiable when viewed from a lower-surface side in the pivotal direction (the D2 direction in FIG. 3). It is noted that the area of the surface 238 is less than that of each of surfaces different from the two surfaces having the largest areas among the plurality of surfaces forming the outer shape of the weight 230 as the plate-like member, i.e., the connecting surface 231 and the surface 233. The surface 238 on which the second identifier 234 is provided is not parallel with any of the two surfaces having the largest areas (the connecting surface 231 and the surface 233) and the surface 235. In other words, the surface 238 on which the second identifier 234 can intersect the two surfaces having the largest areas, and the surface 235. Likewise, the surface 235 is not the two surfaces having the largest areas and can intersect the two surfaces having the largest areas. The surface 235 is visually recognizable when viewed from below in the state in which the weight 230 is mounted on the weight mount portion 201. Thus, the surface 238 is visually recognizable when viewed from below even in the state in which the weight 230 is mounted on the weight mount portion 201. In other words, the second identifier 234 provided on the surface 238 is visually recognizable when viewed in the direction perpendicular to the surface 233 having the first identifier 232 (the direction of the assembly of the weight 230 to the hammer body portion 205) and is not visually recognizable when viewed in a direction parallel with the surface 233 (noted that the up and down direction is one example of the direction). The surface 238 having the second identifier 234 intersects the surface 233 such that a projected area of the surface 238 on an imaginary plane orthogonal to the direction parallel with the surface 233 (the horizontal plane orthogonal to the up and down direction) is not zero when the surface 238 is viewed in the direction parallel with the surface 233 (when viewed from below, for example).

However, the present disclosure is not limited to this configuration. For example, the surface having the second identifier 234 may be a surface formed by cutting a corner defined by the surface 233 having the first identifier 232 and a surface 237 near the rear end portion 212 and continuing to the connecting surface 231. In this case, the surface having the second identifier 234 continues to the surface 233 and the surface 237. The second identifier 234 is identifiable when viewed in the direction of the assembly of the weight 230 to the hammer body portion 205 (the direction in which the pivot axis extends and the D1 direction in FIG. 3). The second identifier 234 is identifiable also when viewed in the direction in which the hammer assembly 200 extends (the direction from the back side toward the front side when viewed from the player in the state in which the hammer assembly is assembled to the keyboard apparatus, the D3 direction in FIG. 3, and the one example of the second direction). Thus, the second identifier 234 is identifiable also after the hammer assembly 200 is assembled to the keyboard apparatus, resulting in a good operation efficiency when checking whether the arrangement of the assembled hammer assemblies is correct, for example. The first identifier 232 is not identifiable when viewed in the direction in which the hammer assembly 200 extends (the direction from the back side toward the front side when viewed from the player, and the D3 direction in FIG. 3). Thus, the second identifier 234 is preferably provided on the surface connecting between the surface continuing to the connecting surface 231 and visually recognizable, and the surface 233 opposed to the connecting surface 231. In the present embodiment, the surface 235 and the surface 237 are visually recognizable, and surfaces opposed to the respective surfaces 235, 237 are not visually recognizable. However, the present disclosure is not limited to this configuration. For example, in the case where the connecting portion 240 and the first weight supporting wall 201X1 are continuous to each other in the hammer body portion 205, the weight 230 is exposed from between the connecting portion 240 and the first weight supporting wall 201X1 and visually recognizable from an upper-surface side in the pivotal direction (the D2 direction in FIG. 3). In this case, the second identifier 234 may be provided on a surface connecting between a visually-recognizable upper-surface portion in the pivotal direction (the D2 direction in FIG. 3) and the surface 233 opposed to the connecting surface 231. It is noted that the surface 233 is one example of at least one surface different from the flat surface, and the surface 238 is another example of at least one surface different from the flat surface. The surface formed by cutting the corner defined by the surface 233 and the surface 235 is yet another example of at least one surface different from the flat surface. The surface formed by cutting the corner defined by the surface 233 and the surface 237 is yet another example of at least one surface different from the flat surface.

Thus, the second identifier 234 is formed on the surface continuing to the surface 233 and the surface 235 or to the surface 233 and the surface 237, making it possible to provide second identification information at the same time when the first identifier 232 is provided on the surface 233, resulting in good workability of providing the identification information.

In the present embodiment, the weight 230 is shaped like a plate. However, the present disclosure is not limited to this configuration. For example, the weight 230 may be shaped like a hemisphere or a spherical segment. In this case, the flat region is the connecting surface 231 of the weight 230 and has the first identifier 232 and the second identifier 234 at a spherical crown. The second identifier 234 at least needs to be visually recognizable in a direction in which the first identifier 232 is visually recognizable, and be not visually recognizable in a direction in which the first identifier 232 is not visually recognizable.

Each of the second identifiers 234 has positional information about a corresponding one of the weights of the eighty-eight types corresponding to the respective keys, i.e., all the white keys (WH) and the black keys (BL). In other words, each of the second identifiers 234 has information about an arrangement ordinal number of a corresponding one of the hammer assemblies 200 corresponding respectively to the white keys and the black keys. In this example, numbers are assigned respectively to all the white keys and the black keys in order of pitch from the low-pitched sound portion toward the high-pitched sound portion. However, the present disclosure is not limited to this configuration, letters, signs, or colors having ordinal concept may be provided on the second identifiers 234 instead of numbers. The position at which the second identifier 234 is provided may be different among the weights 230 as long as the positional relationship between the first identifier 232 described above and the second identifier 234. Thus, the second identifier 234 may indicate information at the position at which the second identifier 234 is provided. Since the second identifier 234 having this information is provided on the surface 238, the weight 230 is easily identifiable even after the weight 230 is connected to the hammer body portion 205. This prevents misidentification of the weight 230 or the hammer assembly 200, thereby improving management of the eighty-eight types of the weights 230 or the hammer assemblies 200. The second identifier 234 of the surface 238 is easily identifiable even after the hammer assemblies 200 are assembled to the keyboard assembly 10. This improves the productivity and the inspection efficiency when the eighty-eight types of the hammer assemblies 200 are assembled to the keyboard assembly 10. While the eighty-eight types of the hammer assemblies are provided, the number of the hammer assemblies is not limited to this number. For example, the hammer assemblies may be common in each octave to provide eight types or four types of the hammer assemblies, and the number of the types of the hammer assemblies may be related to another classification of key range. In this case, an identifier indicating an ordinal number or the like related to a key range is used as identification information.

Figure 8A:
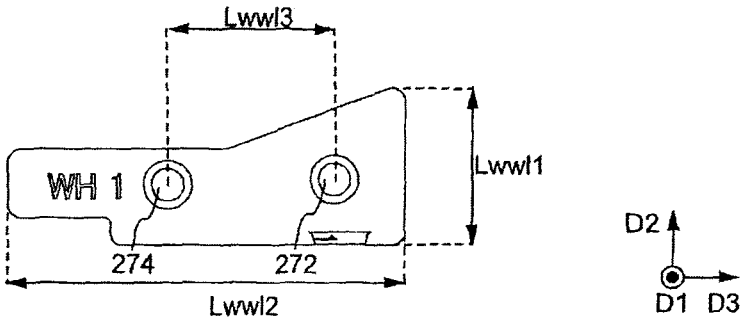
FIGS. 8A through 8C are views for explaining detailed configurations of the weights in the one embodiment.
Figure 8B:
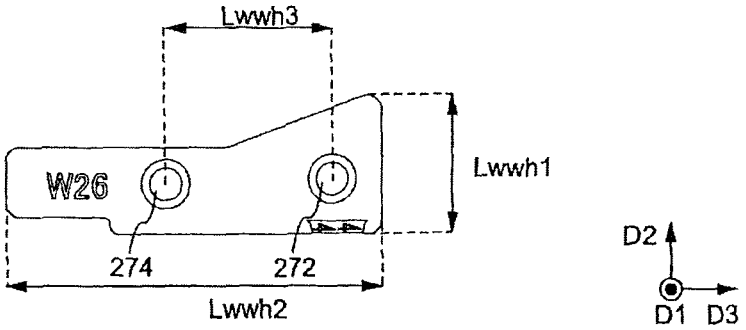
Figure 8C:
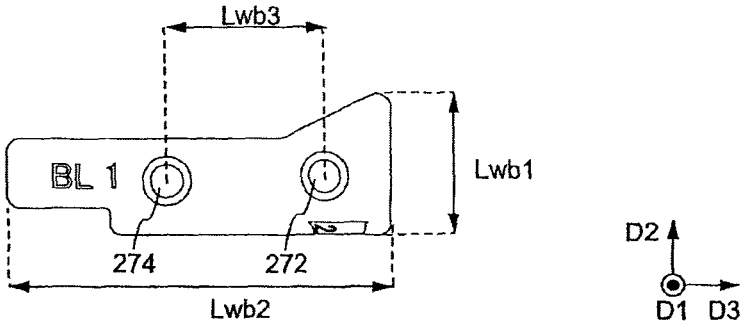

FIGS. 8A-8C are views for explaining the weight in the one embodiment. FIG. 8A is a view of the weight 230*w*1 corresponding to the low-pitched-sound white key which is viewed in the scale direction (the pivot-shaft direction and the D1 direction in FIG. 3). FIG. 8B is a view of a weight 230*wh* corresponding to the high-pitched-sound white key which is viewed in the scale direction (the direction in which the pivot shaft extends and the D1 direction in FIG. 3). FIG. 8C is a view of a weight 230*b* corresponding to the black key which is viewed in the scale direction (the direction in which the pivot shaft extends and the D1 direction in FIG. 3). As illustrated in FIGS. 8A-8C, the external dimension of the weight 230 can be classified into at least three types, i.e., the weight 230*w*1 corresponding to the low-pitched-sound white key, the weight 230*wh* corresponding to the high-pitched-sound white key, and the weight 230*b* corresponding to the black key. The largest distance Lwwl1 in the pivotal direction D2 on the weight 230*w*1 corresponding to the low-pitched-sound white key, the largest distance Lwwh1 in the pivotal direction D2 on the weight 230*wh* corresponding to the high-pitched-sound white key, the largest distance Lwb1 in the pivotal direction D2 on the weight 230*b* corresponding to the black key are different from each other. The distance Lwb1 is adjusted to be greater than the distance Lwwh1, and the distance Lwwl1 is adjusted to be greater than the distance Lwb1. The largest distance Lwwl2 on the weight 230*w*1 corresponding to the low-pitched-sound white key in the direction D3 in which the hammer assembly extends, the largest distance Lwwh2 on the weight 230*wh* corresponding to the high-pitched-sound white key in the direction D3 in which the hammer assembly extends, and the largest distance Lwb2 on the weight 230*b* corresponding to the black key in the direction D3 in which the hammer assembly extends are different from each other. The distance Lwb2 is adjusted to be greater than the distance Lwwh2, and the distance Lwwl2 is adjusted to be greater than the distance Lwb2.

Though not illustrated in FIGS. 8A-8C, the distance in the scale direction D1 at a portion of the hammer assembly near the rear end portion 212 is the same among the weight 230*w*1 corresponding to the low-pitched-sound white key, the weight 230*wh* corresponding to the high-pitched-sound white key, and the weight 230*b* corresponding to the black key. As illustrated in FIG. 7B, the distance of the weight 230*w*1 in the thickness direction D1 has a gradient so as to increase with change in position in the direction in which the hammer assembly extends (the direction from the back side toward the front side when viewed from the player in the state in which the hammer assembly is assembled to the keyboard apparatus, and the D3 direction in FIG. 3). The distance of each of the weight 230*wh* and the weight 230*b* in the thickness direction D1 has the same gradient as the distance of the weight 230*w*1 in the thickness direction D1. Since the largest distance in the direction D3 in which the hammer assembly extends is different among the weight 230*w*1, the weight 230*wh*, and the weight 230*b*, the largest distance in the scale direction D1 is also different among the weight 230*w*1, the weight 230*wh*, and the weight 230*b*. The distance of each of the weight 230*w*1, the weight 230*wh*, and the weight 230*b* in the scale direction D1 at a portion of the hammer assembly near the pivot center (a front side when viewed from the player) is adjusted so as to be greater in the weight 230*b* than in the weight 230*wh* and greater in the weight 230*w*1 than in the weight 230*b*.

The number of the weights 230*w*1 corresponding to the low-pitched-sound white keys is 25, the number of the weights 230*wh* corresponding to the high-pitched-sound white keys is 27, and the number of the weights 230*b* corresponding to the black keys is 36, but the present disclosure are not limited to these numbers. While the weights 230 have the external dimensions (the outer shapes) corresponding to the two types of the white keys and the one type of the black key, the present disclosure is not limited to this number of types. For example, the keys may be of two types: one type for the white key and one type for the black key, and the keys may be of three or more types.

The distance between a first screw through hole 272 corresponding to the first screw 271 and a second screw through hole 274 corresponding to the second screw 273 is different among the weight 230*w*1, the weight 230*wh*, and the weight 230*b* to prevent wrong connection of the weight 230 to the hammer body portion 205. In this example, the distance Lwb3 from the first screw through hole 272 to the second screw through hole 274 in the weight 230*b* corresponding to the black key is adjusted so as to be less than each of the distances Lwwl3, Lwwh3 from the first screw through hole 272 to the second screw through hole 274 in a corresponding one of the weights 230*w*1, 230*wh* corresponding to the white keys. The distances Lwwl3, Lwwh3 between the first screw through hole 272 and the second screw through hole 274 is the same between the weight 230*w*1 corresponding to the low-pitched-sound white key and the weight 230*wh* corresponding to the high-pitched-sound white key. However, the present disclosure is not limited to this, and the distance from the first screw through hole 272 to the second screw through hole 274 may be reversed between each of the weight 230*w*1 and the weight 230*wh* corresponding to the white keys and the weight 230*b* corresponding to the black key. The number of the screw through holes may be different between each of the weight 230*w*1 and the weight 230*wh* corresponding to the white key and the weight 230*b* corresponding to the black key. Each of the hammer body portions 205 corresponding to the respective weights 230 at least needs to have the screw holders corresponding to the distance and/or the number of the screw holes. Since the weight 230 and the hammer body portion 205 respectively have the screw through holes and the screw holders corresponding to each combination, it is possible to prevent wrong connection between the weight 230 and the hammer body portion 205, resulting in improved productivity.

Figure 9:
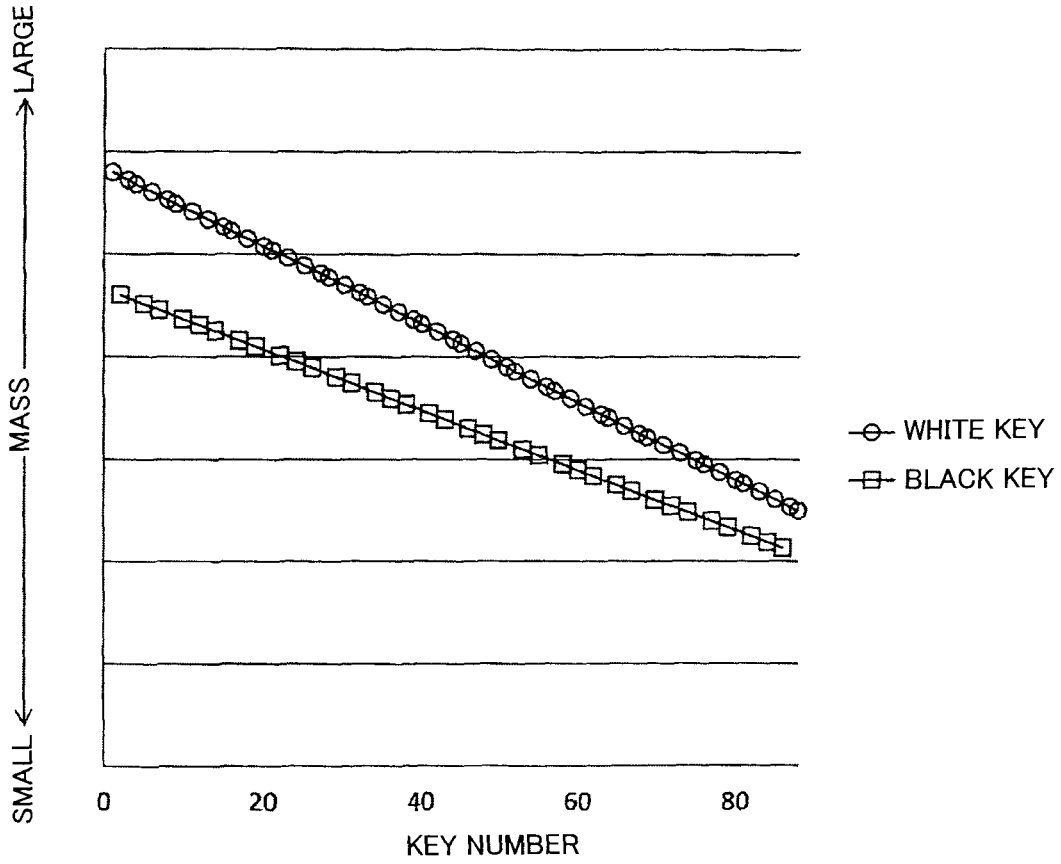
FIG. 9 is a view illustrating a relationship between the pitch corresponding to each key and the mass of the weight in the one embodiment.

FIG. 9 is a view representing a relationship between the pitch corresponding to each key and the mass of the weight in the one embodiment. As illustrated in FIG. 9, the different weights 230 corresponding to the respective keys have different masses, and the weights 230 are arranged in descending order of weight from the low-pitched sound portion toward the high-pitched sound portion in order of pitch. The mass of the weight 230 with respect to the pitch always changes linearly at the constant rate from the low-pitched sound portion to the high-pitched sound portion. However, the present disclosure is not limited to this, and the mass of the weight 230 with respect to the pitch may change nonlinearly. In the present embodiment, since the distance Lhw2 from the force-applied portion 211 to the bearing 220 in the hammer body portion 205*w* corresponding to the white key is different from the distance Lhb2 from the force-applied portion 211 to the bearing 220 in the hammer body portion 205*b* corresponding to the black key, a relationship between the pitch and the mass of the weight in each of the weight 230*w*1 corresponding to the low-pitched-sound white key and the weight 230*wh* corresponding to the high-pitched-sound white key is independent of a relationship between the pitch and the mass of the weight in the weight 230*b* corresponding to the black key. By adjusting the distance from the force-applied portion 211 to the bearing 220 in the hammer body portion 205 and the mass of the weight 230 and the center of gravity, it is possible to adjust a touch feeling stepwise from the low-pitched sound portion toward the high-pitched sound portion through the white keys and the black keys. It is noted that since the mass of the hammer body portion 205 is considerably smaller than that of the weight 230, the mass and the center of gravity of the hammer assembly 200 are substantially the same as the mass and the center of gravity of the weight 230, respectively.

Figure 10A:
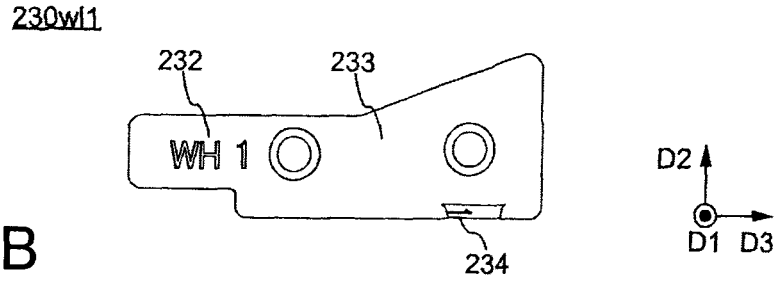
FIGS. 10A through 10E are views for explaining the detailed configurations of the weights in the one embodiment.
Figure 10B:
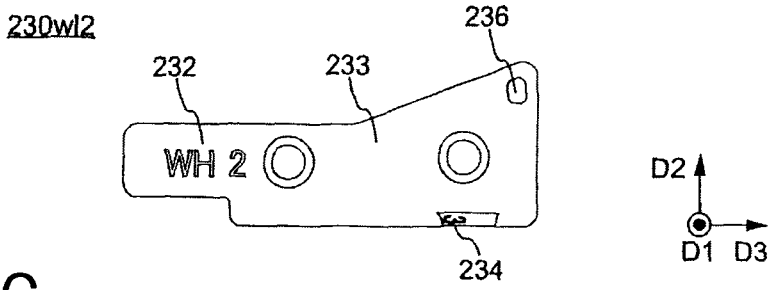
Figure 10C:
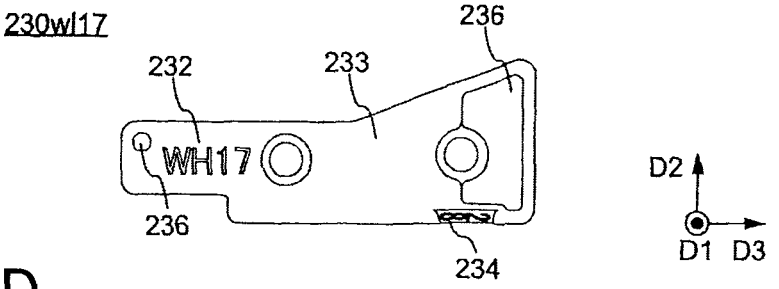
Figure 10D:
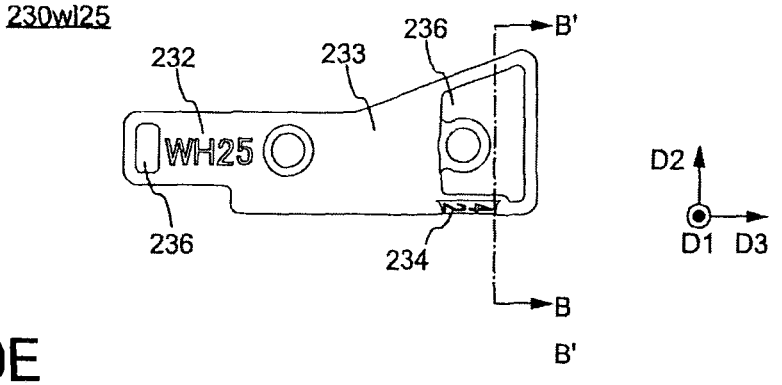
Figure 10E:
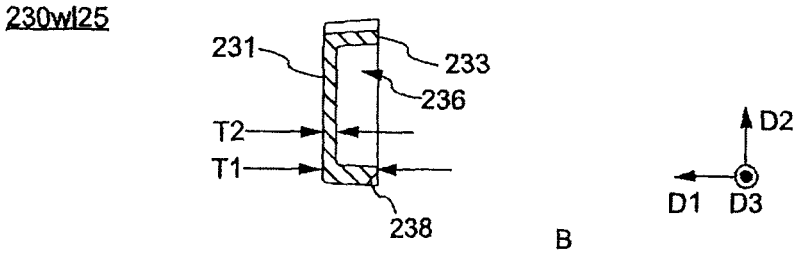

FIGS. 10A-10E are views for explaining the weights in the one embodiment. FIG. 10A is a view of the weight 230*w*11 (as one example of a second member of a first pivot member) corresponding to the lowest-pitched-sound white key which is viewed in the direction of the assembly of the weight 230 to the hammer body portion 205 (the pivot-shaft direction and the D1 direction in FIG. 3). FIG. 10B is a view of a weight 230*w*12 (as one example of a second member of a second pivot member) corresponding to the low-pitched-sound-side second white key which is viewed in the direction of the assembly of the weight 230 to the hammer body portion 205 (the pivot-shaft direction and the D1 direction in FIG. 3). FIG. 10C is a view of a weight 230*w*117 corresponding to the low-pitched-sound-side seventeenth white key which is viewed in the direction of the assembly of the weight 230 to the hammer body portion 205 (the pivot-shaft direction and the D1 direction in FIG. 3). FIG. 10D is a view of a weight 230*wl*25 corresponding to the low-pitched-sound-side twenty-fifth white key which is viewed in the direction of the assembly of the weight 230 to the hammer body portion 205 (the pivot-shaft direction and the D1 direction in FIG. 3). FIG. 10E is a cross-sectional view of the weight 230*wl*25 corresponding to the low-pitched-sound-side twenty-fifth white key, taken along line B-B'. As illustrated in FIGS. 10C-10E, since the weights 230*w*1 having the same external dimension are formed so as to have different masses, the weight 230*w*1 includes a recessed portion 236 on a surface different from the connecting surface 231 connected to the hammer body portion 205. It is noted that an explanation will be provided for the weight 230*w*1 corresponding to the low-pitched-sound white key, but the same configuration may be applied to the weight 230*wh* corresponding to the high-pitched-sound white key and the weight 230*b* corresponding to the black key.

While FIGS. 10A-10E illustrate the weights 230*w*1 corresponding to the four low-pitched-sound white keys by way of example, the external dimensions of all of the weights 230*w*1 corresponding to the twenty-five low-pitched-sound white keys are the same as each other. In the case where numbers 1-25 are assigned respectively to the twenty-five low-pitched-sound-side white keys in order from the low-pitched-sound side, the weight 230*w*11 corresponding to the lowest-pitched-sound white key is the heaviest, and the weight 230*wl*25 corresponding to the low-pitched-sound-side twenty-fifth white key is the lightest. Since this mass gradient is formed, the weight 230 has the recessed portion 236 at the surface 233 opposed to the connecting surface 231 to which the hammer body portion 205 is connected. The recessed portion 236 is formed in the surface on which the first identifier 232 is provided (hereinafter may be referred to as "the surface 233 having the first identifier 232"). That is, the recessed portion 236 is identifiable when viewed in the direction of the assembly of the weight 230 to the hammer body portion 205 (the pivot-shaft direction and the D1 direction in FIG. 3), and visually recognizable in the direction orthogonal to the connecting surface 231. The recessed portion 236 is formed so as to be located near the bearing 220 in the state in which the weight 230 is assembled to the hammer body portion 205, and is formed such that the mass of the weight 230 as the hammer assembly effectively works by a moment produced in pivotal movement of the hammer assembly. It is noted that the recessed portion may be formed at a desired position in accordance with a load to be imposed in pressing of the key. The recessed portion 236 may be a through hole.

FIG. 10E is a cross-sectional view taken along line B-B', illustrating the weight 230*wl*25 corresponding to the low-pitched-sound-side twenty-fifth white key which is viewed in the direction in which the hammer assembly 200 extends (the direction from the back side toward the front side when viewed from the player, and the D3 direction in FIG. 3). As illustrated in FIG. 10E, the weight 230*wl*25 is adjusted such that the distance T2 of the region in the recessed portion 236 in the thickness direction is less than the distance T1 of the other region in the thickness direction. The distance T2 in the thickness direction is substantially the same in the region of the recessed portion 236 of the weight 230*w*1. As illustrated in FIGS. 10B-10D, the different recessed portions 236 of the respective weights 230*w*1 have different sizes (different areas) when viewed in the direction of the assembly of the weight 230 to the hammer body portion 205 (the pivot-shaft direction and the D1 direction in FIG. 3). The mass of the weight 230*w*1 decreases in inverse proportion to the size of the recessed portion 236 of the weight 230*w*1 when viewed in the direction of assembly of the weight 230 to the hammer body portion 205 (the pivot-shaft direction and the D1 direction in FIG. 3). In the weights 230 having the same external dimension (outer shape), the size of the recessed portion 236 when viewed in the direction of assembly of the weight 230 to the hammer body portion 205 (the pivot-shaft direction and the D1 direction in FIG. 3) increases from the low-pitched sound portion toward the high-pitched sound portion in order of pitch. Since the weights 230 corresponding to the respective keys have the above-described recessed portions 236, the mass of the weight 230 decreases from the low-pitched sound portion toward the high-pitched sound portion in order of pitch.

The recessed portion 236 of each of the weights 230 is disposed in the surface 233 opposed to the connecting surface 231, on a pivot-center side (a front side when viewed from the player). In the weights 230, the size of the recessed portion 236 in the direction in which the hammer assembly 200 extends (the direction from the front side toward the back side when viewed from the player in the state in which the hammer assembly 200 is assembled to the keyboard apparatus) increases with increase in the size of the recessed portion 236 when viewed in the direction in which the weight 230 is assembled to the hammer body portion 205 (the pivot-shaft direction and the D1 direction in FIG. 3). However, the present disclosure is not limited to this configuration. For example, as illustrated in FIGS. 10C and 10D, a plurality of the recessed portions 236 may be formed, and one of the recessed portions 236 may be formed near the rear end portion 212 of the hammer body portion 205*w*. Since the different weights 230 have the recessed portions 236 of the different sizes at different positions, the different weights 230 have the different centers of gravity.

The weight 230*wl*25 corresponding to the twenty-fifth low-pitched-sound white key from the low-pitched-sound side is adjusted so as to be heavier than a weight 230*wh*1 corresponding to the twenty-sixth high-pitched-sound white key from the low-pitched-sound side. As illustrated in FIG. 9, the weights 230*w*1 corresponding to the twenty-five low-pitched-sound white keys and the weights 230*wh* corresponding to the twenty-seven high-pitched-sound white keys have a linear relationship between the pitch and the mass of the weight of the white key. Since the recessed portions 236 are formed, even in the case where the weights 230 have the same external dimension or different external dimensions, the weights 230 corresponding to the respective keys can be adjusted such that the weight of the weight 230 decreases stepwise from the low-pitched sound portion toward the high-pitched sound portion in order of pitch.

As described above, the pivot member according to the present embodiment includes the first identifier and the second identifier. This configuration makes it easy to recognize the type of the pivot member from a plurality of directions, thereby improving the productivity and the inspection efficiency of the keyboard apparatus. In the example in the present embodiment, specifically, the two types of the identifiers are viewable from the two directions, making it easy to recognize information required for each of a production process and an inspection process. This makes it possible to use proper information required for each of a process of assembly of the first member and the second member (a state of the assembly alone) and a process for inspecting the order of the pivot members mounted on the keyboard apparatus.

Method of Manufacturing Weight

Figure 11A:
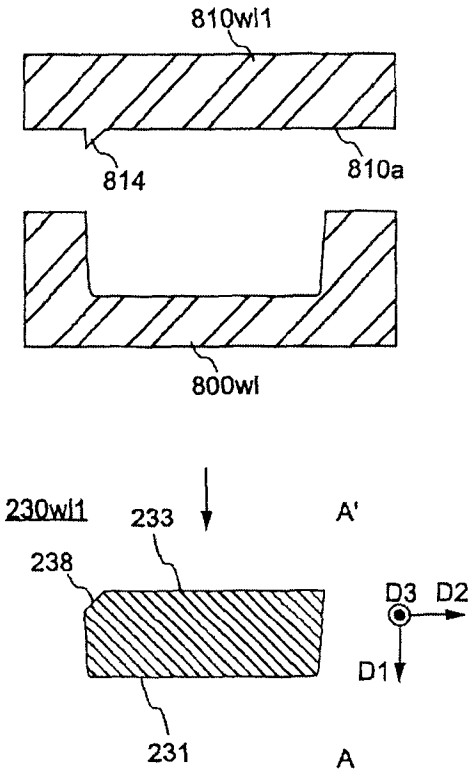
FIGS. 11A through 11C are schematic views for explaining a method of manufacturing the weight in the one embodiment.
Figure 11B:
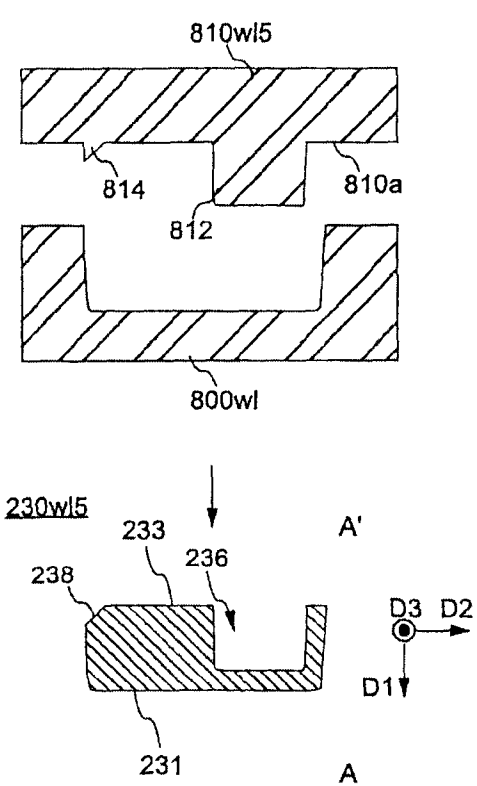
Figure 11C:
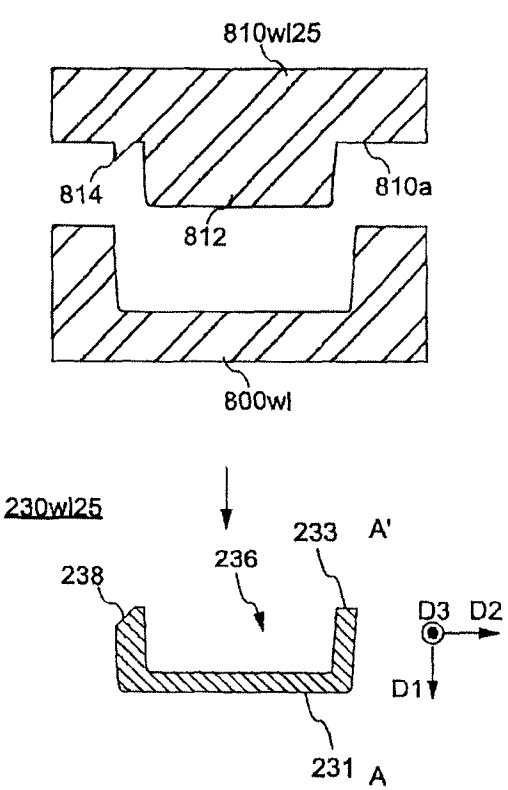

There will be next described a method of manufacturing the weight with reference to FIGS. 11A-11C. FIGS. 11A-11C are schematic views of a metal mold for molding the weight 230, and the weight 230 in the one embodiment of the present disclosure. FIG. 11A is a view of a metal mold for molding the weight 230*w*11 corresponding to the lowest-pitched-sound white key, and the weight 230*w*11. FIG. 11B is a cross-sectional schematic view of a metal mold for molding a weight 230*w*15 corresponding to the low-pitched-sound-side fifth white key, and the weight 230*w*15. FIG. 11C is a cross-sectional schematic view of a metal mold for molding a weight 230*wl*25 corresponding to the low-pitched-sound-side twenty-fifth white key, and the weight 230*wl*25.

The metal mold for forming the weight 230 includes a first metal mold 800 and a second metal mold 810. The first metal mold 800 is a mold for the external dimension of the weight 230. The second metal mold 810 is a mold for the surface 233 opposed to the connecting surface 231 of the weight 230. That is, the first metal mold 800 forms the connecting surface 231 of the weight 230 and surfaces thereof continuing to the connecting surface 231, and the second metal mold 810 forms the surface 233 and the surface 238 of the weight 230. In the present embodiment, the external dimension of the weight 230 can be classified into three types. Thus, three types of the first metal molds 800 are required for the weight 230*w*1 corresponding to the low-pitched-sound white key, the weight 230*wh* corresponding to the high-pitched-sound white key, and the weight 230*b* corresponding to the black key. The first identifier 232 and the recessed portion 236 corresponding to each of the weight 230 are formed in the surface 233 opposed to the connecting surface 231 of the weight 230. The second identifier 234 is formed in the surface 238. Thus, eighty-eight types of the second metal molds 810 are required for eighty-eight types of the weights 230. In the present embodiment, the first metal molds 800 of three types are used to manufacture the eighty-eight types of the weights 230, resulting in lower manufacturing cost of the metal mold and a simpler process of manufacturing the weight 230 than in the case where the first metal mold 800 and the second metal mold 810 are produced for each pitch to manufacture the weight.

As illustrated in FIGS. 11A-11C, the second metal mold 810 includes a first protruding portion 812 and a second protruding portion 814 on a main surface 810*a*. The first protruding portion 812 corresponds to the recessed portion 236 of each of the weights 230, and the second protruding portion 814 corresponds to the surface 238. Each of the first identifier 232 and the second identifier 234 may be indicated by a recessed and protruding structure. In this case, the first identifier 232 and the second identifier 234 of the weight 230 may be provided as protruding portions respectively on the main surface 810*a* and the second protruding portion 814 such that the first identifier 232 and the second identifier 234 are printed as recessed portions. However, the present disclosure is not limited to this configuration, and the first identifier 232 and the second identifier 234 of the weight 230 may be printed as protruding portions. In this case, the first identifier 232 and the second identifier 234 of the weight 230 may be provided as recessed portions respectively in the main surface 810*a* and the second protruding portion 814. The depth of the recessed and protruding structure of the first identifier 232 and the second identifier 234 is considerably shallower than that of the recessed portion 236, providing no effects to the mass and the center of gravity of the weight 230. Since each of the first identifier 232 and the second identifier 234 is indicated by the recessed and protruding structure, it is possible to form the weight 230 as a single unit, thereby further simplifying the process of manufacturing. However, the present disclosure is not limited to this configuration. For example, the first identifier 232 and the second identifier 234 may be printed and may be formed independently.

The first metal mold 800 and the second metal mold 810 for forming the weight 230 has a draft angle for releasing the weight 230 from the metal mold without deformation. Thus, the weight 230 also has a draft angle. In the weight 230 in this example, the external dimension of the surface 233 opposed to the connecting surface 231 is greater than that of the connecting surface 231. In other words, the perimeter of the surface 233 opposed to the connecting surface 231 is greater than the perimeter of the connecting surface 231 of the weight 230.

However, the configurations of the first metal mold 800 and the second metal mold 810 for forming the weight 230 are not limited to these. For example, the first metal mold 800 may be a mold for the external dimension and the surface 233 opposed to the connecting surface 231. In this case, the first metal mold 800 further includes, at a bottom portion of its recessed portion determining the external dimension: the first protruding portion 812 corresponding to the recessed portion 236 of each of the weights 230; and the second protruding portion 814 corresponding to the surface 238. Thus, eighty-eight types of the first metal molds 800 are required. In the present embodiment, the second metal mold 810 of a single type is required to manufacture the eighty-eight types of the weights 230. In the weight 230 to be manufactured, the external dimension of the surface 233 opposed to the connecting surface 231 is less than the external dimension of the connecting surface 231 due to the draft angle of the first metal mold 800. With this configuration, only the single type of the second metal mold 810 is required to manufacture the eighty-eight types of the weights 230, resulting in a much simpler process of manufacturing the weight 230.

Operations of Keyboard Assembly

Figure 12A:
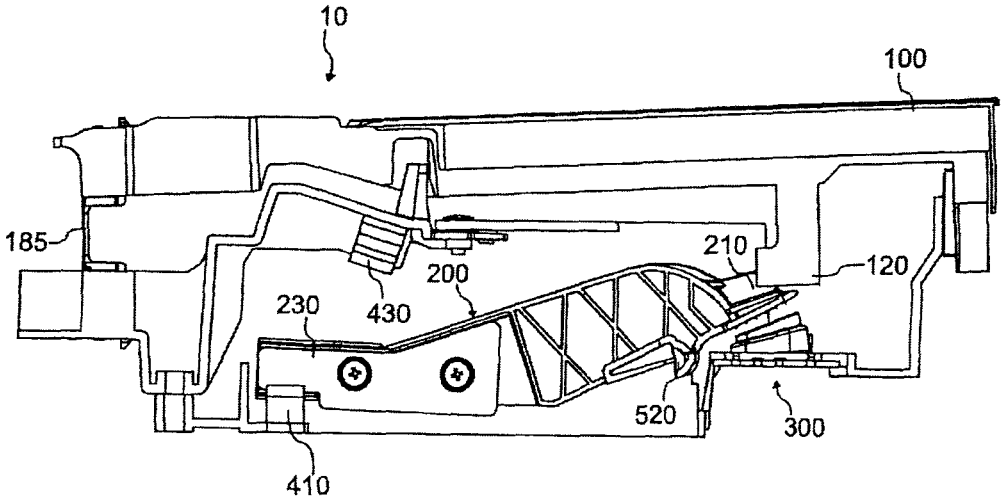
FIGS. 12A and 12B are views for explaining operations of the keyboard assembly when the key (a white key) is depressed in the one embodiment.
Figure 12B:
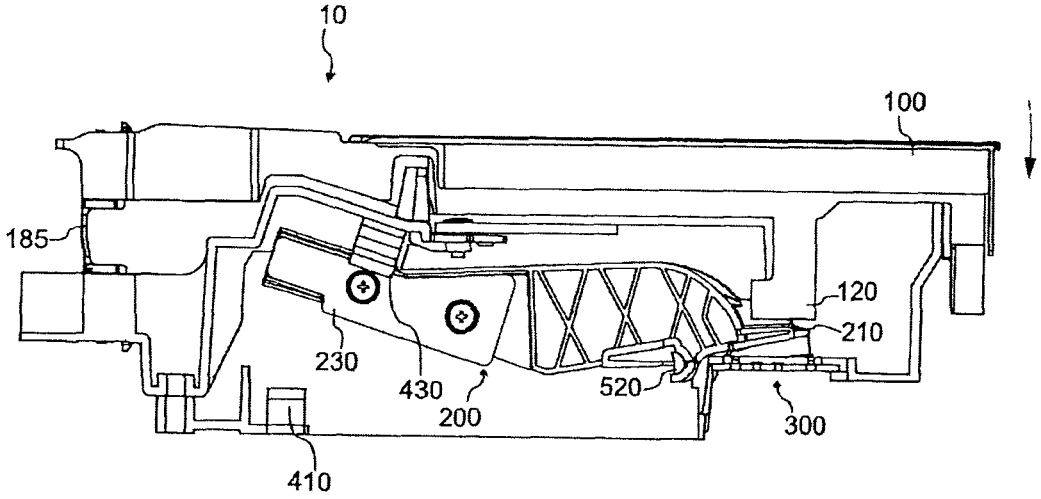

FIGS. 12A and 12B are views for explaining operations of the key assembly when the key (the white key) is depressed in the one embodiment. FIG. 12A is a view illustrating a state in which the key 100 is located at the rest position (that is, the key is not depressed). FIG. 12B is a view illustrating a state in which the key 100 is located at the end position (that is, the key is fully depressed). When the key 100 is pressed, the rod-like flexible member 185 is bent as a pivot center. In this state, the front-end key guide 151 and the side-surface key guide 153 inhibit the key 100 from moving in the front and rear direction, and thereby the key 100 pivots in the up and down direction (the pivotal direction). In response, the hammer supporter 120 depresses the front end portion 210, causing pivotal movement of the hammer assembly 200 about the pivot shaft 520. When the weight 230 collides with the upper stopper 430, the pivotal movement of the hammer assembly 200 is stopped, and the key 100 reaches the end position. When the sensor 300 is pressed by the front end portion 210, the sensor 300 outputs the detection signals in accordance with a plurality of levels of an amount of pressing of the sensor 300 (i.e., the key pressing amount).

When the key is released, the weight 230 moves downward by gravity, the hammer assembly 200 pivots. In response, the front end portion 210 presses the hammer supporter 120 upward, causing upward pivotal movement of the key 100. When the weight 230 comes into contact with the lower stopper 410, the pivotal movement of the hammer assembly 200 is stopped, and the key 100 is returned to the rest position.

In the above-described embodiment, the electronic piano is taken as one example of the keyboard apparatus to which the hammer assembly is applied. The pivot member in the above-described embodiment is not limited to this and may be applied to a hammer assembly of a keyboard mechanism of an acoustic musical instrument in which a sound generator such as a string and a musical bar is struck by a hammer in response to an operation of a key to produce a sound. Alternatively, the pivot member in the above-described embodiment may be applied to a component constituting an action mechanism of a keyboard apparatus as long as the component has a configuration different from that of another component in accordance with pitch. For example, the identifier in the above-described embodiment may be applied to a pivot mechanism of a jack or a support of an action mechanism of a keyboard instrument, which pivot mechanism includes a pivot component and a supporter configured to support the pivot component pivotably.

Figure 13A:
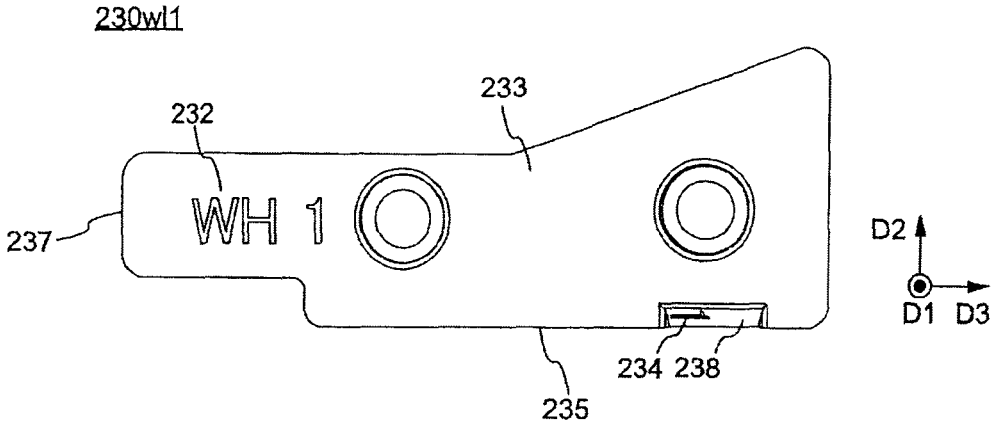
FIG. 13A through 13D are views for explaining a detailed configuration of a weight in a first embodiment.
Figure 13B:
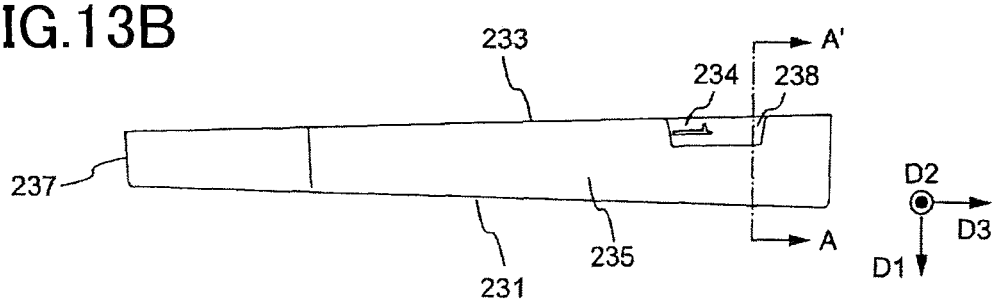
Figure 13C:
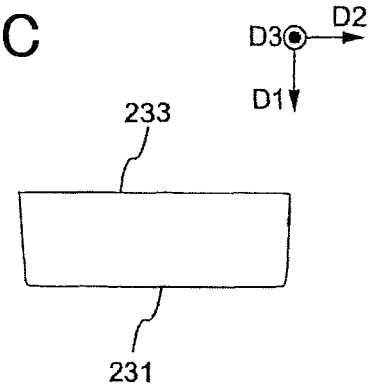
Figure 13D:
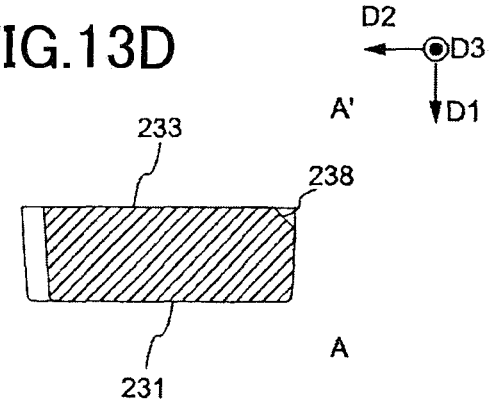

There will be described the weight 230 in the first embodiment in detail. FIGS. 13A-13D are views for explaining the weight in the first embodiment. FIG. 13A is a view of the weight 230*w*11 corresponding to the low-pitched-sound white key which is viewed in the scale direction (the pivot-shaft direction and the D1 direction in FIG. 3). FIG. 13B is a view of the weight 230*w*11 viewed from a lower-surface side in the pivotal direction of the hammer assembly (the D2 direction in FIG. 3). FIG. 13C is a view of the weight 230*w*11 viewed in the direction in which the hammer assembly extends (the direction from the front side toward the back side when viewed from the player in the state in which the hammer assembly is assembled to the keyboard apparatus, and the direction reverse to the D3 direction in FIG. 3). FIG. 13D is a cross-sectional view taken along line A-A', illustrating the weight 230*w*1 corresponding to the low-pitched-sound-side first white key which is viewed in the direction in which the hammer assembly 200 extends (the direction from the back side toward the front side when viewed from the player in the state in which the hammer assembly is assembled to the keyboard apparatus, and the D3 direction in FIG. 3). Each of the weights 230 includes the first identifier 232 and the second identifier 234 for easy identification of the weight 230 corresponding to the corresponding one of the keys.

The weight 230 includes the first identifier 232 on the surface 233 of the weight 230 which is opposed to the connecting surface 231 to which the hammer body portion 205 is connected. Thus, when viewed in the direction of the assembly of the weight 1230 to the hammer body portion 205 (the pivot-shaft direction (the direction in which the pivot axis extends), and the D1 direction in FIG. 3), the first identifier 232 is identifiable not only in the case of the weight 230 alone but also in the case where the weight 230 is assembled to the hammer body portion 205. In other words, the first identifier 232 is visually recognizable in the direction orthogonal to the connecting surface 231. Since the surface 233 is larger in size than the surface 238 which will be described below, it is possible to make the first identifier 232 larger than the second identifier 234. Since the first identifier 232 is larger than the second identifier 234, when the weight 230 is assembled to the hammer body portion 205 and when the hammer assembly 200 is assembled to the keyboard apparatus, the first identifier 232 is easily viewed, resulting in improved productivity. However, the present disclosure is not limited to this configuration. For example, the first identifier 232 may have the same size as that of the second identifier 234 and may be smaller in size than the second identifier 234.

Figure 14A:
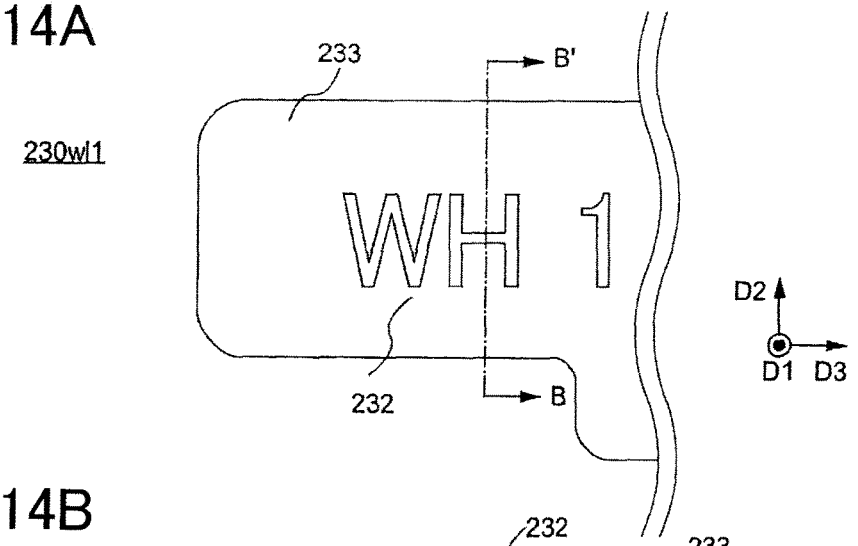
FIGS. 14A through 14D are views for explaining a detailed configuration of a first identifier in the first embodiment.
Figure 14B:
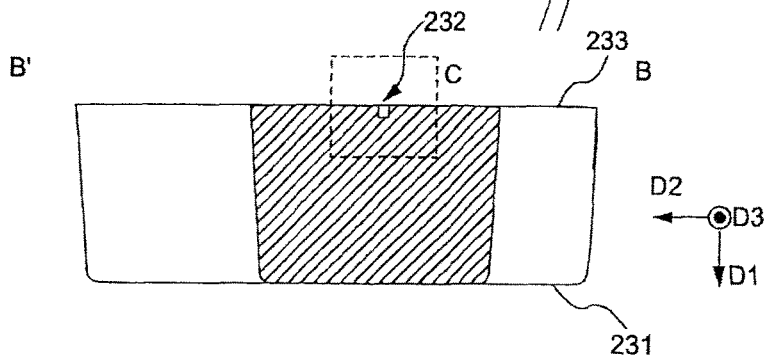
Figure 14C:
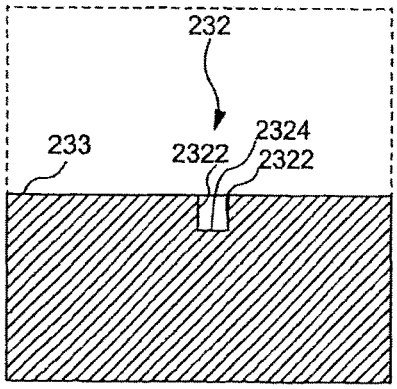

FIGS. 14A-14D are views for explaining a detailed configuration of the first identifier in the present embodiment. FIG. 14A is an enlarged view of the first identifier 232 of the weight 230*w*11 which is viewed in the scale direction (the pivot-shaft direction and the D1 direction in FIG. 3). FIG. 14B is a cross-sectional view taken along line B-B', illustrating the weight 230*w*1 viewed in the direction in which the hammer assembly 200 extends (the direction from the back side toward the front side when viewed from the player in the state in which the hammer assembly is assembled to the keyboard apparatus, and the D3 direction in FIG. 3). FIG. 14C is an enlarged cross-sectional view of a region C including the first identifier 232 in FIG. 14B.

As illustrated in FIG. 14C, the first identifier 232 in the present embodiment has a recessed structure including side surfaces 2322 and a bottom surface 2324 connecting the side surfaces to each other. The side surfaces 2322 of the recessed structure continue to the surface 233 substantially perpendicularly. The side surfaces 2322 of the recessed structure have surface roughness different from that of the surface 233. The bottom surface 2324 of the recessed structure connects the side surfaces 2322 of the recessed structure to each other in substantially parallel with the surface 233. The bottom surface 2324 of the recessed structure has surface roughness different from that of the surface 233.

The side surfaces 2322 of the recessed structure are substantially perpendicular to the pivotal direction of the hammer assembly 200 (the D2 direction in FIG. 3). The angle of each of the side surfaces 2322 with respect to the surface 235 continuing to the connecting surface 231 is less than the angle of the side surface 2322 with respect to the surface 233 opposed to the connecting surface 231. The side surfaces 2322 opposed to each other are substantially parallel with each other. However, the present disclosure is not limited to this configuration. For example, the side surfaces 2322 may not be perpendicular to the surface 233, and the side surfaces 2322 opposed to each other may not be parallel with each other. In this case, the recessed structure formed by the side surfaces 2322 and the bottom surface 2324 preferably has a tapered shape. That is, each of the side surfaces 2322 of the recessed structure preferably continues to the surface 233 at an obtuse angle. The side surfaces 2322 opposed to each other may be connected to each other while intersecting each other in the recessed direction.

The bottom surface 2324 of the recessed structure is visually recognizable in the direction of the assembly of the weight 230 to the hammer body portion 205 (the pivot-shaft direction and the D1 direction in FIG. 3). In other words, the bottom surface 2324 of the recessed structure is visually recognizable in the direction orthogonal to the connecting surface 231. Since the bottom surface 2324 of the recessed structure has surface roughness different from that of the surface 233, the first identifier 232 is visually recognized easily when viewed in the direction of the assembly of the weight 230 to the hammer body portion 205 (the pivot-shaft direction and the D1 direction in FIG. 3). This improves the productivity when the weight 230 is assembled to the hammer body portion 205 and when the hammer assembly 200 is assembled to the keyboard apparatus.

Figure 14D:
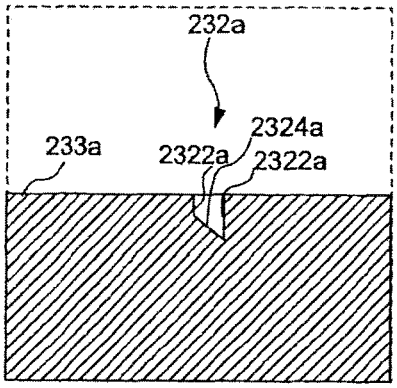

However, the present disclosure is not limited to this configuration. For example, the bottom surface 2324 of the recessed structure may connect the side surfaces 2322 of the recessed structure to each other at an angle with respect to the surface 233. FIG. 14D is an enlarged cross-sectional view of a region including a first identifier 232*a* in a modification of the present embodiment. As illustrated in FIG. 14D, the first identifier 232*a* in the present modification includes a recessed structure including side surfaces 2322*a* and a bottom surface 2324*a* connecting the side surfaces 2322*a* to each other. Each of the side surfaces 2322*a* of the recessed structure continues to a surface 233*a* substantially perpendicularly. Each of the side surfaces 2322*a* of the recessed structure has surface roughness different from that of the surface 233*a*. The bottom surface 2324*a* of the recessed structure connects the side surfaces 2322*a* of the recessed structure to each other at an angle with respect to the surface 233*a*. The bottom surface 2324*a* of the recessed structure has surface roughness different from that of the surface 233*a*.

The bottom surface 2324*a* of the recessed structure is visually recognizable in a direction of assembly of a weight 230*a* to a hammer body portion 205*a* (the pivot-shaft direction and the D1 direction in FIG. 3). In other words, the bottom surface 2324*a* of the recessed structure is visually recognizable in a direction orthogonal to a connecting surface 231*a*. Since the bottom surface 2324*a* of the recessed structure has surface roughness different from that of the surface 233*a*, the first identifier 232 is visually recognized easily when viewed in the direction of the assembly of the weight 230*a* to the hammer body portion 205*a* (the pivot-shaft direction and the D1 direction in FIG. 3). This improves the productivity when the weight 230*a* is assembled to the hammer body portion 205*a* and when a hammer assembly 200*a* is assembled to the keyboard apparatus.

FIGS. 14A-14D illustrate the first identifier 232 as one recessed structure. However, the present disclosure is not limited to this configuration, and the first identifier 232 may be formed by combination of a plurality of recessed structures. The different recessed structures may have different depths, and the recessed structures may be connected to each other. The recessed structure may include another recessed structure.

As illustrated in FIGS. 13A-13C and 15A-15D, the weight 230 has the second identifier 234 on the surface 238 that connects between the surface 235 continuing to the connecting surface 231 and the surface 233 opposed to the connecting surface 231. The surface 238 (a first surface) is formed at an angle θ1, greater than zero degrees and less than 90 degrees, with respect to the connecting surface 231. The angle θ1 of the surface 238 with respect to the connecting surface 231 is less than the angle θ2 of the surface 235 continuing to the connecting surface 231 with respect to the connecting surface 231. That is, the surface 238 (the first surface) intersects the direction of the assembly of the weight 230 to the hammer body portion 205 (the pivot-shaft direction, the D1 direction in FIG. 3, and one example of the axial direction of the pivot axis (shaft)) and intersects a plane (a direction) orthogonal to the pivot axis (the pivotal direction, the D2 direction in FIG. 3, and one example of a direction perpendicular to the axial direction of the pivot axis). As illustrated in FIGS. 13A-13D, in this example, the weight 230 is a plate-like member. The surface 238 is a surface formed by cutting a corner defined by the surface 233 having the first identifier 232 and the surface 235 continuing to the connecting surface 231. Thus, the surface 238 continues to the surface 233 and the surface 235. The second identifier 234 is identifiable when viewed in the direction of the assembly of the weight 230 to the hammer body portion 205 (the pivot-shaft direction and the D1 direction in FIG. 3). In other words, the second identifier 234 is visually recognizable in the direction orthogonal to the connecting surface 231. The second identifier 234 is also identifiable when viewed from a lower-surface side in the pivotal direction (the D2 direction in FIG. 3). The first identifier 232 is not identifiable when viewed from a lower-surface side in the pivotal direction (the D2 direction in FIG. 3).

However, the present disclosure is not limited to this configuration. For example, the surface having the second identifier 234 may be a surface formed by cutting a corner defined by the surface 233 having the first identifier 232 and the surface 237 near the rear end portion 212 and continuing to the connecting surface 231. In this case, the surface having the second identifier 234 continues to the surface 233 and the surface 237. The second identifier 234 is identifiable when viewed in the direction of the assembly of the weight 230 to the hammer body portion 205 (the pivot-shaft direction and the D1 direction in FIG. 3). The second identifier 234 is identifiable also when viewed in the direction in which the hammer assembly 200 extends (the direction from the back side toward the front side when viewed from the player in the state in which the hammer assembly is assembled to the keyboard apparatus, and the D3 direction in FIG. 3). Thus, the second identifier 234 is identifiable also after the hammer assembly 200 is assembled to the keyboard apparatus, resulting in a good operation efficiency when checking whether the arrangement of the assembled hammer assemblies is correct, for example. The first identifier 232 is not identifiable when viewed in the direction in which the hammer assembly 200 extends (the direction from the back side toward the front side when viewed from the player, and the D3 direction in FIG. 3). Thus, the second identifier 234 is preferably provided on the surface connecting between the surface continuing to the connecting surface 231 and visually recognizable, and the surface 233 opposed to the connecting surface 231. In the present embodiment, the surface 235 and the surface 237 are visually recognizable, and surfaces opposed to the respective surfaces 235, 237 are not visually recognizable. However, the present disclosure is not limited to this configuration. For example, in the case where the connecting portion 240 and the first weight supporting wall 201X1 are continuous to each other in the hammer body portion 205, the weight 230 is exposed from between the connecting portion 240 and the first weight supporting wall 201X1 and visually recognizable from an upper-surface side in the pivotal direction (the D2 direction in FIG. 3). In this case, the second identifier 234 may be provided on a surface connecting between a visually-recognizable upper-surface portion in the pivotal direction (the D2 direction in FIG. 3) and the surface 233 opposed to the connecting surface 231. In the case where the weight 230 protrudes from the weight mount portion 201 toward the rear end portion 212 of the hammer body portion 205, for example, the weight 230 is exposed from the rear end portion 212 and visually recognizable in a direction reverse to the direction of the assembly of the weight 230 to the hammer body portion 205 (the pivot-shaft direction and a direction reverse to the D1 direction in FIG. 3). In this case, the surface having the second identifier 234 may be a surface formed by cutting a corner defined by the connecting surface 231 and the surface 237 near the rear end portion 212 and continuing to the connecting surface 231. In this case, the surface having the second identifier 234 continues to the surface 231 and the surface 237. The second identifier 234 is identifiable when viewed in a direction reverse to the direction of the assembly of the weight 230 to the hammer body portion 205 (the pivot-shaft direction and the direction reverse to the D1 direction in FIG. 3). The second identifier 234 is identifiable also when viewed in the direction in which the hammer assembly 200 extends (the direction from the back side toward the front side when viewed from the player in the state in which the hammer assembly is assembled to the keyboard apparatus, and the D3 direction in FIG. 3).

Figure 15A:
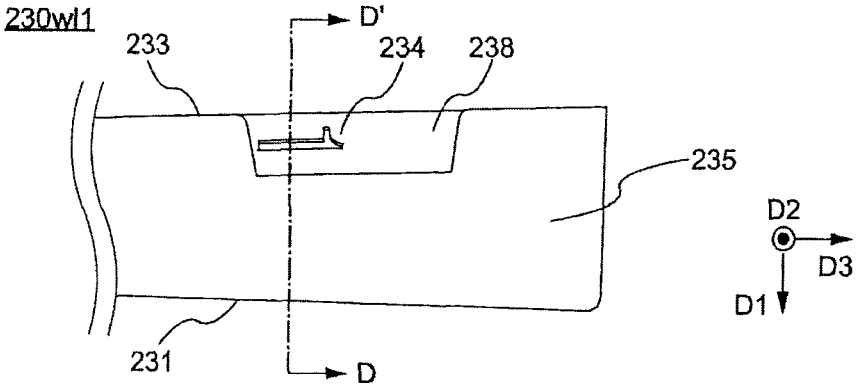
FIGS. 15A through 15D are views for explaining a detailed configuration of a second identifier in the first embodiment.

FIGS. 15A-16D are views for explaining a detailed configuration of a second identifier in the present embodiment (as one example of an identifier provided on the first surface). FIG. 15A is an enlarged view of the second identifier 234 of the weight 230*w*11 which is viewed from a lower-surface side in the pivotal direction (the D2 direction in FIG. 3). The surface 238 (as one example of the first surface) is formed so as to cut a portion of a top portion (a corner portion) continuing to the surface 233 opposed to the connecting surface 231 and the surface 235 continuing to the connecting surface 231. FIG. 15B is a cross-sectional view taken along line D-D', illustrating the weight 230*w*1 viewed in the direction in which the hammer assembly 200 extends (the direction from the back side toward the front side when viewed from the player in the state in which the hammer assembly is assembled to the keyboard apparatus, and the D3 direction in FIG. 3). FIG. 15C is an enlarged cross-sectional view of a region E including the second identifier 234 in FIG. 15B. FIG. 16A is an enlarged view of the second identifier 234 of the weight 230*w*11 which is viewed in the direction of the assembly of the weight 230 to the hammer body portion 205 (the pivot-shaft direction and the D1 direction in FIG. 3). FIG. 16B is a cross-sectional view taken along line F-F', illustrating the weight 230*w*1 viewed from an upper-surface side in the pivotal direction (a direction reverse to the D2 direction in FIG. 3). The angle a1 of the surface 238 having the second identifier 234 with respect to the surface 233 opposed to the connecting surface 231 is greater than the angle a2 of the surface 238 with respect to the surface 235 continuing to the connecting surface 231. The angle a1 of the surface 238 with respect to the surface 233 opposed to the connecting surface 231 is an obtuse angle greater than 90 degrees. It is noted that the weight 230*w* is a plate-like member, and two surfaces having the largest areas among a plurality of surfaces forming the outer shape of the weight 230*w* (the surface having the largest area and the surface having the second largest area among the plurality of surfaces) are the connecting surface 231 and the surface 233. In a state in which the weight 230*w* is mounted on the weight mount portion 201 of the hammer body portion 205, the surface 233 on which the first identifier 232 is provided is located farther from the weight mount portion 201 than the connecting surface 231. The connecting surface 231 and the surface 233 are two surfaces having the largest areas when the weight 230*w* is viewed in the direction in which the pivot axis extends, among the plurality of surfaces forming the outer shape of the weight 230.

Figure 15B:
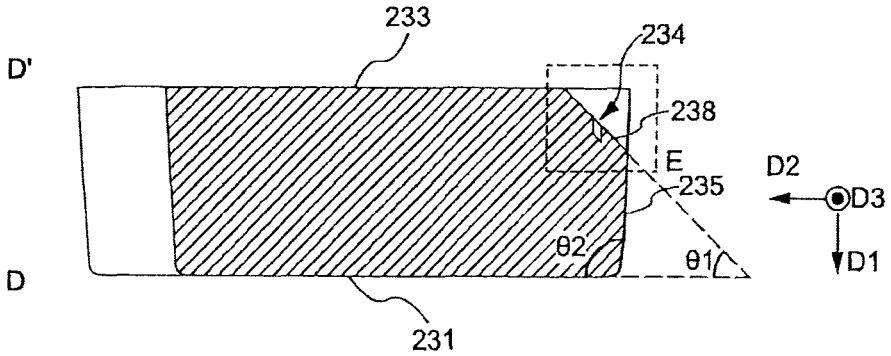
Figure 15C:
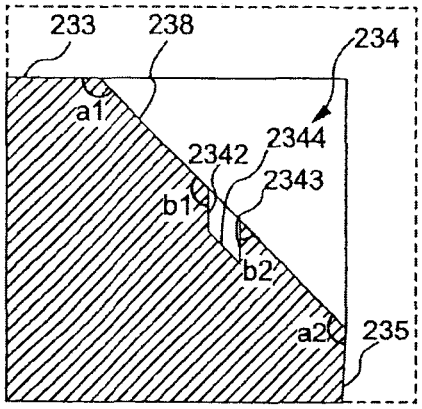
Figure 16A:
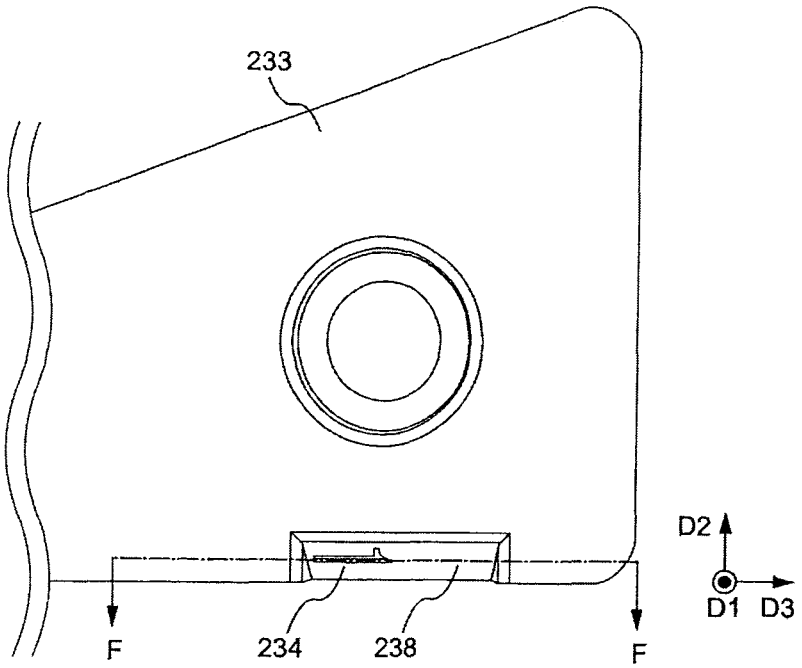
FIGS. 16A through 16C are views for explaining a detailed configuration of the second identifier in the first embodiment.
Figure 16B:
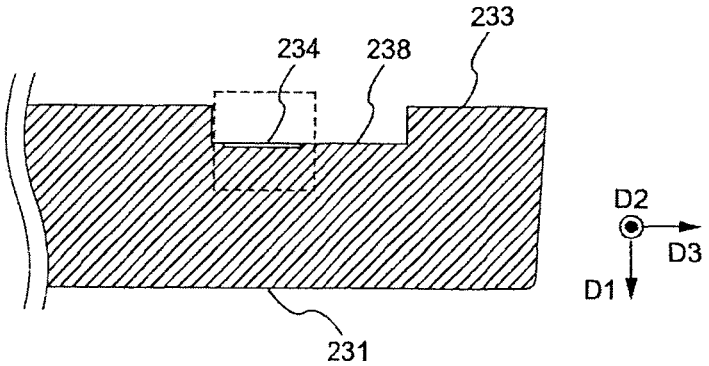
Figure 16C:
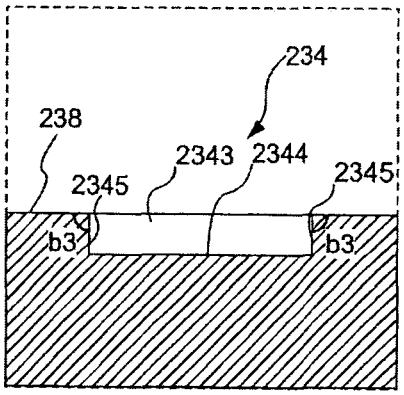

As illustrated in FIGS. 15C and 16C, the second identifier 234 according to the present embodiment includes a recessed structure including: a side surface 2342 (as one example of a second surface); a side surface 2343 opposed to the side surface 2342 (as one example of a third surface); side surfaces 2345 (each as one example of a fifth surface) connecting the side surface 2342 and the side surface 2343 to each other; and a bottom surface 2344 (as one example of a fourth surface) connecting the side surfaces to each other. The side surface 2342 (as one example of the second surface) of the recessed structure continues to the surface 238 (as one example of the first surface) at an obtuse angle b1. The side surface 2343 (as one example of the third surface) of the recessed structure which is opposed to the side surface 2342 (as one example of the second surface) of the recessed structure continues to the surface 238 (as one example of the first surface) at an acute angle b2. Each of the side surfaces 2345 (as one example of the fifth surface) of the recessed structure continues to the surface 238 (as one example of the first surface) at a substantially perpendicular angle b3 so as to connect the side surface 2342 (as one example of the second surface) and the side surface 2343 (as one example of the third surface) of the recessed structure. Each of the side surface 2342, the side surface 2343, and the side surfaces 2345 of the recessed structure has surface roughness different from that of the surface 238 (as one example of the first surface). It is noted that, as illustrated in FIG. 15B, the D2 direction coincides with the up direction for the recessed structure provided in the surface 238. In the case where the D2 direction is used as a reference, the side surface 2342 is an upper inner surface defining an upper surface of the recessed structure, and the side surface 2343 is a lower inner surface defining a lower surface of the recessed structure. In the present disclosure, however, as illustrated in FIG. 15B, the depth direction of the recessed structure provided in the surface 238 is defined as a direction parallel with the up and down direction in the figure, and side surfaces of the protruding structure are defined as the side surface 2342 and the side surface 2343 each of which is a surface substantially parallel with the depth direction of the recessed structure. Thus, the term "side surface" in the present disclosure should not be construed so as to be limited only to a surface which defines the protruding structure or the recessed structure and extends parallel with the up and down direction. That is, the term "the side surface" in the present disclosure includes a surface of the recessed structure which extends substantially parallel with the depth direction of the recessed structure and includes a surface of the protruding structure which extends substantially parallel with the height direction (the upright direction) of the protruding structure.

Each of the side surface 2342 (as one example of the second surface), the side surface 2343 (as one example of the third surface), and the side surfaces 2345 (as one example of the fifth surface) is substantially perpendicular to the surface 233 opposed to the connecting surface 231. That is, each of the side surface 2342 (as one example of the second surface), the side surface 2343 (as one example of the third surface), and the side surfaces 2345 (as one example of the fifth surface) is substantially perpendicular to the pivotal direction of the hammer assembly 200 (the D2 direction in FIG. 3). The angle of each of the side surface 2342 (as one example of the second surface), the side surface 2343 (as one example of the third surface), and the side surfaces 2345 (as one example of the fifth surface) with respect to the surface 235 continuing to the connecting surface 231 is less than the angle of each of the side surface 2342 (as one example of the second surface), the side surface 2343 (as one example of the third surface), and the side surfaces 2345 (as one example of the fifth surface) with respect to the surface 233 opposed to the connecting surface 231. The side surface 2342 (as one example of the second surface) and the side surface 2343 (as one example of the third surface) opposed to each other are substantially parallel with each other. However, the present disclosure is not limited to this configuration. For example, each of the side surface 2342 (as one example of the second surface), the side surface 2343 (as one example of the third surface), and the side surfaces 2345 (as one example of the fifth surface) may not be perpendicular to the surface 233, and the side surface 2342 (as one example of the second surface) and the side surface 2343 (as one example of the third surface) opposed to each other may not be parallel with each other. In this case, the recessed structure formed by the side surface 2342 (as one example of the second surface), the side surface 2343 (as one example of the third surface), the side surfaces 2345 (as one example of the fifth surface), and the bottom surface 2344 (as one example of the fourth surface) preferably has a tapered shape. The side surface 2342 (as one example of the second surface) and the side surface 2343 (as one example of the third surface) opposed to each other may be connected to each other while intersecting each other in the recessed direction.

At least a portion of the side surface 2342 (as one example of the second surface) is visually recognizable in a direction orthogonal to the surface 238 (as one example of the first surface). Since the side surface 2342 (as one example of the second surface) of the recessed structure has surface roughness different from that of the surface 238 (as one example of the first surface), the second identifier 234 is visually recognized easily when viewed in the direction orthogonal to the surface 238 (as one example of the first surface). At least a portion of the side surface 2342 (as one example of the second surface) is visually recognizable also when viewed from a lower-surface side in the pivotal direction (the D2 direction in FIG. 3). Since the side surface 2342 (as one example of the second surface) of the recessed structure has surface roughness different from that of the surface 238 (as one example of the first surface), the second identifier 234 is visually recognized easily when viewed from a lower-surface side in the pivotal direction (the D2 direction in FIG. 3). This improves the productivity when the weight 230 is assembled to the hammer body portion 205 and when the hammer assembly 200 is assembled to the keyboard apparatus.

The bottom surface 2344 (as one example of the fourth surface) of the recessed structure connects the side surface 2342 (as one example of the second surface), the side surface 2343 (as one example of the third surface), and the side surfaces 2345 (as one example of the fifth surface) of the recessed structure to each other in substantially parallel with the surface 238 (as one example of the first surface). The bottom surface 2344 (as one example of the fourth surface) of the recessed structure has surface roughness different from that of the surface 238 (as one example of the first surface). The bottom surface 2344 (as one example of the fourth surface) of the recessed structure has surface roughness different from that of each of the side surface 2342 (as one example of the second surface), the side surface 2343 (as one example of the third surface), and the side surfaces 2345 (as one example of the fifth surface).

At least a portion of the bottom surface 2344 (as one example of the fourth surface) is visually recognizable in a direction orthogonal to the surface 238 (as one example of the first surface). Since the bottom surface 2344 (as one example of the fourth surface) of the recessed structure has surface roughness different from that of the surface 238 (as one example of the first surface), the second identifier 234 is visually recognized easily when viewed in the direction orthogonal to the surface 238 (as one example of the first surface). Since the bottom surface 2344 (as one example of the fourth surface) of the recessed structure has surface roughness different from that of the side surface 2342 (as one example of the second surface), the second identifier 234 is visually recognized easily when viewed in the direction orthogonal to the surface 238 (as one example of the first surface). The bottom surface 2344 (as one example of the fourth surface) is visually recognizable also when viewed in the direction of the assembly of the weight 230 to the hammer body portion 205 (the pivot-shaft direction and the D1 direction in FIG. 3). Since the bottom surface 2344 (as one example of the fourth surface) of the recessed structure has surface roughness different from that of the surface 238 (as one example of the first surface), the second identifier 234 is visually recognized easily when viewed in the direction of the assembly of the weight 230 to the hammer body portion 205 (the pivot-shaft direction and the D1 direction in FIG. 3). This improves the productivity when the weight 230 is assembled to the hammer body portion 205 and when the hammer assembly 200 is assembled to the keyboard apparatus.

As illustrated in this figure, the surface 238 (as one example of the first surface) is formed at the angle θ1, less than 90 degrees, with respect to the connecting surface 231. That is, the surface 238 (as one example of the first surface) intersects the direction of the assembly of the weight 230 to the hammer body portion 205 (the pivot-shaft direction and the D1 direction in FIG. 3). That is, since the second identifier is provided on the inclined surface, the second identifier is recognizable both in the pivotal direction of the hammer and in the direction of the assembly of the weight, and since the bottom surface (as one example of the fourth surface) of the second identifier is different in surface roughness from each of the surface 238 (as one example of the first surface), the side surface 2342 (as one example of the second surface), and the side surface 2343 (as one example of the third surface) opposed to the side surface 2342, the identifying information is easily recognized.

Figure 15D:
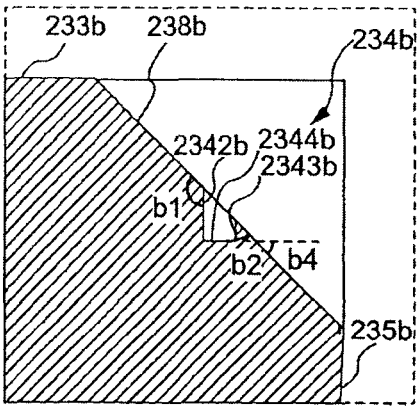

However, the present disclosure is not limited to this configuration. For example, the bottom surface 2344 (as one example of the fourth surface) of the recessed structure may connect the side surface 2342 (as one example of the second surface) and the side surface 2343 (as one example of the third surface) of the recessed structure to each other at an angle b4 with respect to the surface 238 (as one example of the first surface). FIG. 15D is an enlarged cross-sectional view of a region including a second identifier 234*b* in a modification of the present embodiment. As illustrated in FIG. 15D, the second identifier 234*b* in the present modification includes a recessed structure including: a side surface 2342*b* (as one example of the second surface); a side surface 2343*b* (as one example of the third surface) opposed to the side surface 2342*b*; side surfaces 2345*b* (each as one example of the fifth surface) connecting the side surface 2342*b* and the side surface 2343*b* to each other; and a bottom surface 2344*b* (as one example of the fourth surface) connecting the side surface 2342*b* and the side surface 2343*b* to each other. The side surface 2342*b* (as one example of the second surface) of the recessed structure continues to the surface 238*b* (as one example of the first surface) at the obtuse angle b1. The side surface 2343*b* (as one example of the third surface) of the recessed structure which is opposed to the side surface 2342*b* (as one example of the second surface) of the recessed structure continues to the surface 238*b* (as one example of the first surface) at the acute angle b2. Each of the side surfaces 2345*b* (as one example of the fifth surface) of the recessed structure continues to the surface 238*b* (as one example of the first surface) at the substantially perpendicular angle b3 so as to connect the side surface 2342*b* (as one example of the second surface) and the side surface 2343*b* (as one example of the third surface) of the recessed structure to each other. Each of the side surface 2342*b*, the side surface 2343*b*, and the side surfaces 2345*b* of the recessed structure has surface roughness different from that of the surface 238*b*.

At least a portion of the side surface 2342*b* (as one example of the second surface) is visually recognizable in a direction orthogonal to the surface 238*b* (as one example of the first surface). Since the side surface 2342*b* (as one example of the second surface) of the recessed structure has surface roughness different from that of the surface 238*b* (as one example of the first surface), the second identifier 234*b* is visually recognized easily when viewed in the direction orthogonal to the surface 238*b* (as one example of the first surface). At least a portion of the side surface 2342*b* (as one example of the second surface) is visually recognizable also when viewed from a lower-surface side in the pivotal direction (the D2 direction in FIG. 3). Since the side surface 2342*b* (as one example of the second surface) of the recessed structure has surface roughness different from that of the surface 238*b* (as one example of the first surface), the second identifier 234*b* is visually recognized easily when viewed from a lower-surface side in the pivotal direction (the D2 direction in FIG. 3). This improves the productivity when the weight 230*b* is assembled to the hammer body portion 205*b* and when the hammer assembly 200*b* is assembled to the keyboard apparatus.

The bottom surface 2344*b* (as one example of the fourth surface) of the recessed structure connects the side surface 2342*b* (as one example of the second surface), the side surface 2343*b* (as one example of the third surface), and the side surfaces 2345*b* (each as one example of the fifth surface) of the recessed structure to each other at the angle b4 with respect to the surface 238*b* (as one example of the first surface). The bottom surface 2344*b* (as one example of the fourth surface) of the recessed structure has surface roughness different from that of the surface 238*b* (as one example of the first surface). The bottom surface 2344*b* (as one example of the fourth surface) of the recessed structure has surface roughness different from that of each of the side surface 2342*b* (as one example of the second surface), the side surface 2343*b* (as one example of the third surface), and the side surfaces 2345*b* (each as one example of the fifth surface).

At least a portion of the bottom surface 2344*b* (as one example of the fourth surface) is visually recognizable in a direction orthogonal to the surface 238*b* (as one example of the first surface). Since the bottom surface 2344*b* (as one example of the fourth surface) of the recessed structure has surface roughness different from that of the surface 238*b* (as one example of the first surface), the second identifier 234*b* is visually recognized easily when viewed in the direction orthogonal to the surface 238*b* (as one example of the first surface). Since the bottom surface 2344*b* (as one example of the fourth surface) of the recessed structure has surface roughness different from that of the side surface 2342*b* (as one example of the second surface), the second identifier 234*b* is visually recognized easily when viewed in the direction orthogonal to the surface 238*b* (as one example of the first surface). The bottom surface 2344*b* (as one example of the fourth surface) is visually recognizable also when viewed in a direction of assembly of the weight 230*b* to the hammer body portion 205*b* (the pivot-shaft direction and the D1 direction in FIG. 3). Since the bottom surface 2344*b* (as one example of the fourth surface) of the recessed structure has surface roughness different from that of the surface 238*b* (as one example of the first surface), the second identifier 234*b* is visually recognized easily in the direction of the assembly of the weight 230*b* to the hammer body portion 205*b* (the pivot-shaft direction and the D1 direction in FIG. 3). This improves the productivity when the weight 230*b* is assembled to the hammer body portion 205*b* and when the hammer assembly 200*b* is assembled to the keyboard apparatus.

FIGS. 15A-16C illustrate the second identifier 234 as one recessed structure. However, the present disclosure is not limited to this configuration, and the second identifier 234 may be formed by combination of a plurality of recessed structures. The different recessed structures may have different depths, and the recessed structures may be connected to each other. The recessed structure may include another recessed structure. Each of the side surfaces 2322 of the recessed structure of the first identifier 232 and each of the side surface 2342 (as one example of the second surface), the side surface 2343 (as one example of the third surface), and the side surfaces 2345 (as one example of the fifth surface) of the recessed structure of the second identifier 234 are substantially parallel with each other.

In the present embodiment, the weight 230 is shaped like a plate. However, the present disclosure is not limited to this configuration. For example, the weight 230 may be shaped like a hemisphere or a spherical segment. In this case, the flat region is the connecting surface 231 of the weight 230 and has the first identifier 232 and the second identifier 234 at a spherical crown. The second identifier 234 at least needs to be visually recognizable in a direction in which the first identifier 232 is visually recognizable, and be not visually recognizable in a direction in which the first identifier 232 is not visually recognizable.

It is noted that, when manufacturing the weight 230, the first metal mold 800 and the second metal mold 810 in FIGS. 11A-11C are capable of forming surfaces of the weight 230 different from each other in surface roughness. In FIGS. 11A-11C, the weight 230 is released from the first metal mold 800 and the second metal mold 810 in the D1 direction. The first metal mold 800 and the second metal mold 810 have surfaces having different angles, which surfaces are formed so as to be different from each other in surface roughness. A surface closely parallel with a direction of the releasing (the D1 direction) may have small surface roughness with consideration of interference in the releasing. However, the present disclosure is not limited to this configuration, and the surface roughness of each surface only needs to be set such that the releasing can be performed. For example, the metal mold may be configured such that a surface closely parallel to a release direction (the D1 direction) has such surface roughness that the releasing can be performed, and a surface perpendicular to the release direction has surface roughness that is greater than that of the surface closely parallel to the release direction (the D1 direction). The surfaces of the first metal mold 800 and the second metal mold 810 may be different in surface roughness from each other in advance. Using these first metal mold 800 and second metal mold 810 makes it possible to form the weight 230 having desired surface roughness. The surface of the weight 230 may be polished after the releasing, for example. Surface processing on the weight 230 enables the weight 230 to have desired surface roughness on each surface.

First Modification

In a first modification, there will be described a first identifier and a second identifier different in configuration from the first identifier and the second identifier in the first embodiment. It is noted that an explanation will be omitted for elements in the second embodiment which are similar to those in the first embodiment.

Figure 17A:
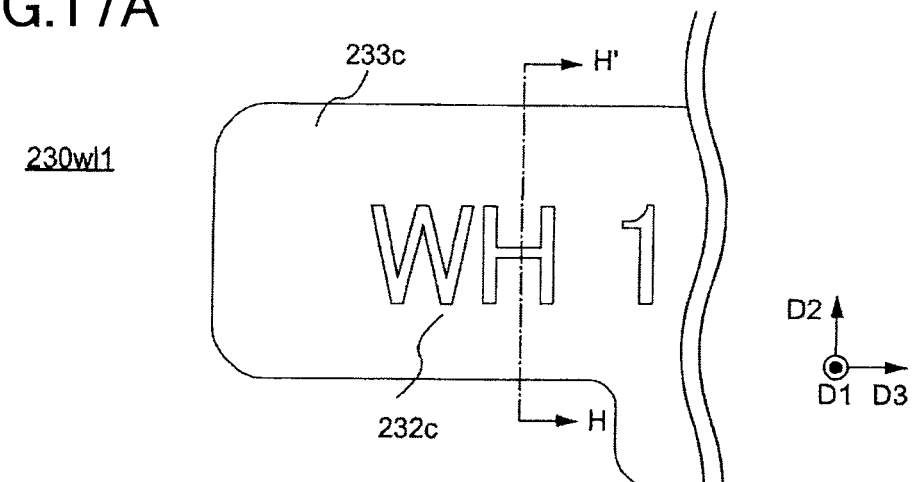
FIGS. 17A through 17D are views for explaining a detailed configuration of a first identifier in a first modification.
Figure 17B:
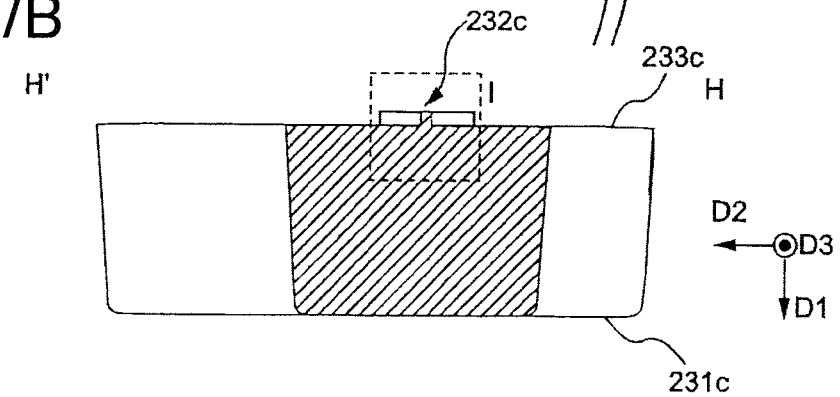

FIGS. 17A-17D are views for explaining a detailed configuration of the first identifier in the present modification. FIG. 17A is an enlarged view of a first identifier 232*c* of the weight 230*w*1 which is viewed in the scale direction (the pivot-shaft direction and the D1 direction in FIG. 3). FIG. 17B is a cross-sectional view taken along line H-H', illustrating the weight 230*w*1 viewed in the direction in which the hammer assembly 200 extends (the direction from the back side toward the front side when viewed from the player in the state in which the hammer assembly is assembled to the keyboard apparatus, and the D3 direction in FIG. 3).

Figure 17C:
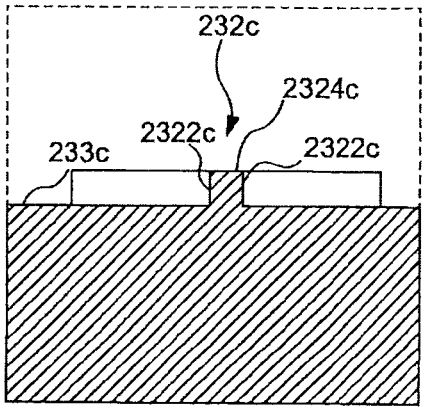

FIG. 17C is an enlarged cross-sectional view of a region I including the first identifier 232*c* in FIG. 17B.

As illustrated in FIG. 17C, the first identifier 232*c* in the present embodiment includes a protruding structure including side surfaces 2322*c* and an upper surface 2324*c* connecting the side surfaces to each other. Each of the side surfaces 2322*c* of the protruding structure continues to a surface 233*c* substantially perpendicularly. Each of the side surfaces 2322*c* of the protruding structure has surface roughness different from that of the surface 233*c*. The upper surface 2324*c* of the protruding structure connects the side surfaces 2322*c* of the protruding structure to each other in substantially parallel with the surface 233*c*. The upper surface 2324*c* of the protruding structure has surface roughness different from that of the surface 233*c*.

The side surfaces 2322*c* of the protruding structure are substantially perpendicular to the pivotal direction of the hammer assembly 200*c* (the D2 direction in FIG. 3). The angle of each of the side surfaces 2322*c* with respect to a surface 235*c* continuing to a connecting surface 231*c* is less than the angle of the side surface 2322*c* with respect to the surface 233*c* opposed to the connecting surface 231*c*. The side surfaces 2322*c* opposed to each other are substantially parallel with each other. However, the present disclosure is not limited to this configuration. For example, the side surfaces 2322*c* may not be perpendicular to the surface 233*c*, and the side surfaces 2322*c* opposed to each other may not be parallel with each other. In this case, the protruding structure formed by the side surfaces 2322*c* and the upper surface 2324*c* preferably has a tapered shape. That is, each of the side surfaces 2322*c* of the protruding structure is preferably continues to the surface 233*c* at an obtuse angle. The side surfaces 2322*c* opposed to each other may be connected to each other while intersecting each other in the protruding direction.

The upper surface 2324*c* of the protruding structure is visually recognizable in a direction of assembly of a weight 230*c* to a hammer body portion 205*c* (the pivot-shaft direction and the D1 direction in FIG. 3). In other words, the upper surface 2324*c* of the protruding structure is visually recognizable in a direction orthogonal to the connecting surface 231*c*. Since the upper surface 2324*c* of the protruding structure has surface roughness different from that of the surface 233*c*, the first identifier 232*c* is visually recognized easily when viewed in the direction of the assembly of the weight 230*c* to the hammer body portion 205*c* (the pivot-shaft direction and the D1 direction in FIG. 3). This improves the productivity when the weight 230*c* is assembled to the hammer body portion 205*c* and when the hammer assembly 200*c* is assembled to the keyboard apparatus.

Figure 17D:
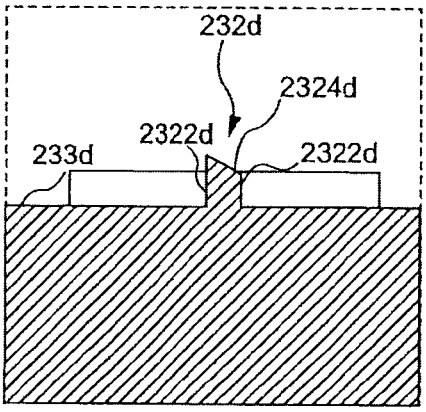

However, the present disclosure is not limited to this configuration. For example, the upper surface 2324*c* of the protruding structure may connect the side surfaces 2322*c* of the protruding structure to each other at an angle with respect to the surface 233*c*. FIG. 17D is an enlarged cross-sectional view of a region including a first identifier 232*d* in a modification of the present embodiment. As illustrated in FIG. 17D, the first identifier 232*d* in the present modification includes a protruding structure including an upper surface 2324*d* connecting a side surface 2322*d* and a side surface 2322*d* to each other. Each of the side surfaces 2322*d* of the protruding structure continues to a surface 233*d* substantially perpendicularly. Each of the side surfaces 2322*d* of the protruding structure has surface roughness different from that of the surface 233*d*. The upper surface 2324*d* of the protruding structure connects the side surfaces 2322*d* of the protruding structure to each other at an angle with respect to the surface 233*d*. The upper surface 2324*d* of the protruding structure has surface roughness different from that of the surface 233*d*.

The upper surface 2324*d* configured as described above is visually recognizable in a direction of assembly of the weight 230*d* to a hammer body portion 205*d* (the pivot-shaft direction and the D1 direction in FIG. 3). In other words, the upper surface 2324*d* configured as described above is visually recognizable in a direction orthogonal to a connecting surface 231*d*. Since the upper surface 2324*d* of the protruding structure has surface roughness different from that of the surface 233*d*, the first identifier 232*d* is visually recognized easily when viewed in the direction of the assembly of the weight 230*d* to the hammer body portion 205*d* (the pivot-shaft direction and the D1 direction in FIG. 3). This improves the productivity when the weight 230*d* is assembled to the hammer body portion 205*d* and when a hammer assembly 200*d* is assembled to the keyboard apparatus.

FIGS. 17A-17D illustrate the first identifier 232 as one protruding structure. However, the present disclosure is not limited to this configuration, and the first identifier 232 may be formed by combination of a plurality of protruding structures. The different protruding structures may have different heights, and the protruding structures may be connected to each other. Another protruding structure may be provided on the protruding structure.

Figure 18A:
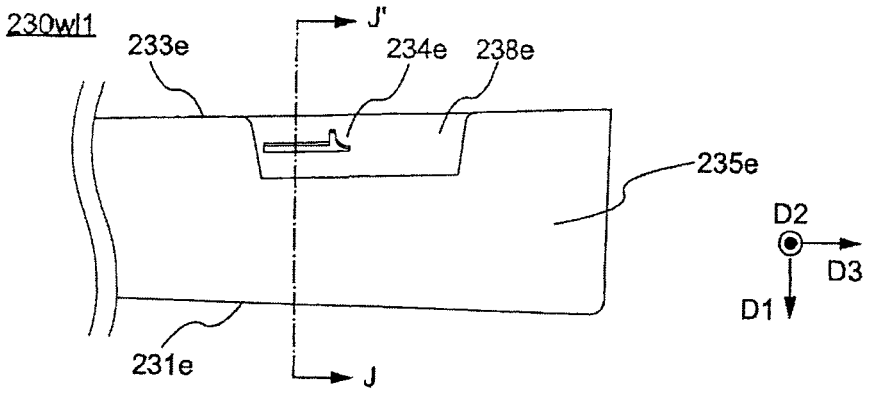
FIGS. 18A through 18D are views for explaining a detailed configuration of a second identifier in the first modification.
Figure 18B:
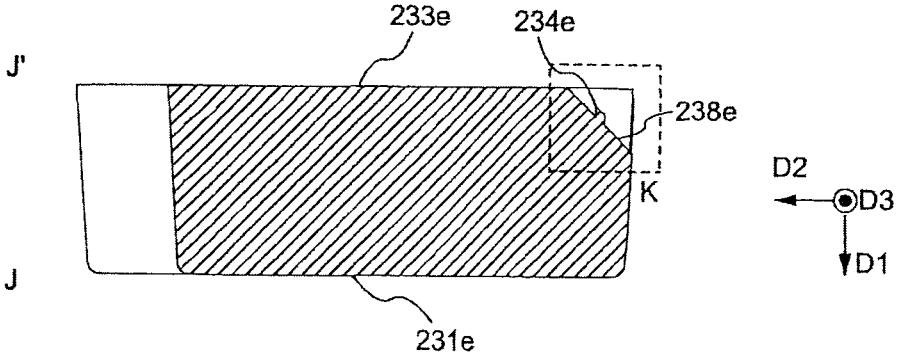

FIGS. 18A-19C are views each for explaining a detailed configuration of a second identifier in the present modification. FIG. 18A is an enlarged view of a second identifier 234*e* of the weight 230*w*11 which is viewed from a lower-surface side in the pivotal direction (the D2 direction in FIG. 3). FIG. 18B is a cross-sectional view taken along line J-J', illustrating the weight 230*w*1 viewed in a direction in which a hammer assembly 200*e* extends (the direction from the back side toward the front side when viewed from the player in the state in which the hammer assembly is assembled to the keyboard apparatus, and the D3 direction in FIG. 3). FIG. 18C is an enlarged cross-sectional view of a region K including the second identifier 234*e* in FIG. 18B. FIG. 19A is an enlarged view of the second identifier 234*e* of the weight 230*w*11 which is viewed in a direction of assembly of a weight 230*e* to a hammer body portion 205*e* (the pivot-shaft direction and the D1 direction in FIG. 3). FIG. 19B is a cross-sectional view taken along line L-L', illustrating the weight 230*w*1 viewed from an upper-surface side in the pivotal direction (the direction reverse to the D2 direction in FIG. 3). The angle a1 of a surface 238*e* having a second identifier 234*e* with respect to a surface 233*e* opposed to a connecting surface 231*e* is greater than the angle a2 of the surface 238*e* with respect to a surface 235*e* continuing to the connecting surface 231*e*.

Figure 18C:
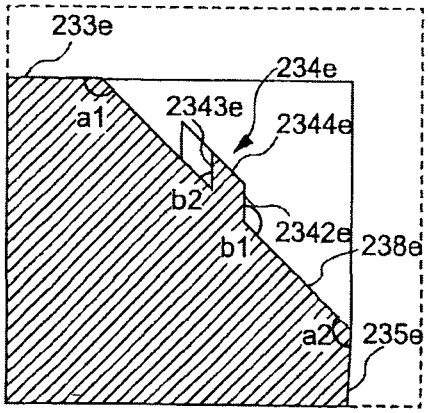
Figure 19A:
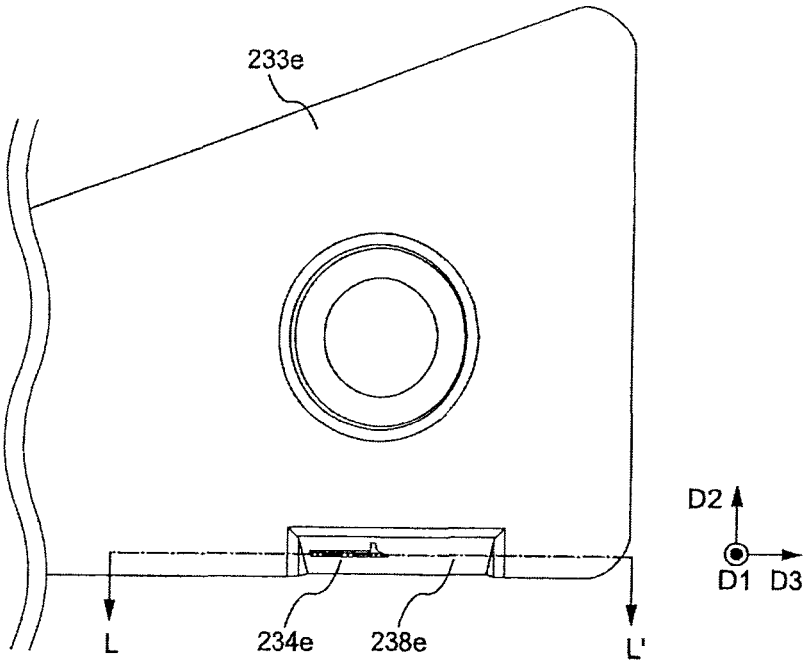
FIGS. 19A through 19C are views for explaining a detailed configuration of the second identifier in the first modification.
Figure 19B:
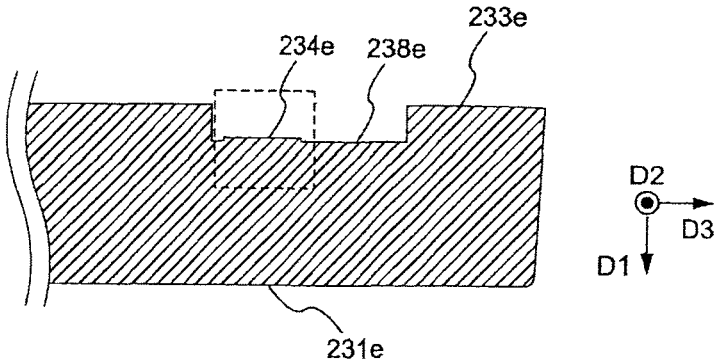
Figure 19C:
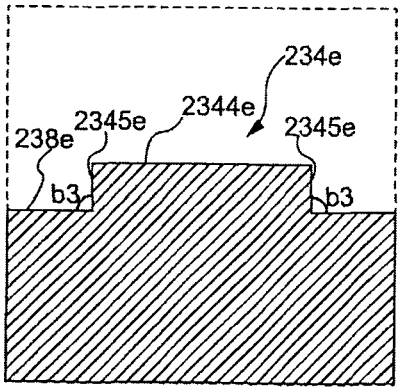
Figure 20A:
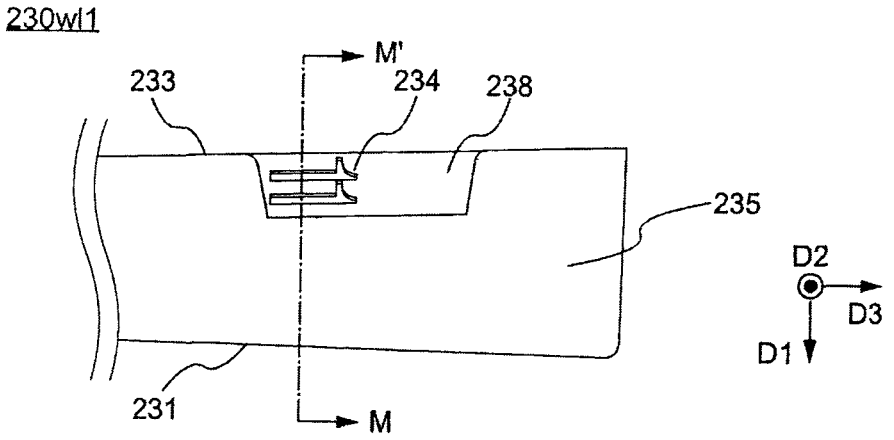
FIGS. 20A through 20D are views for explaining a detailed configuration of the second identifier in the first modification.
Figure 20B:
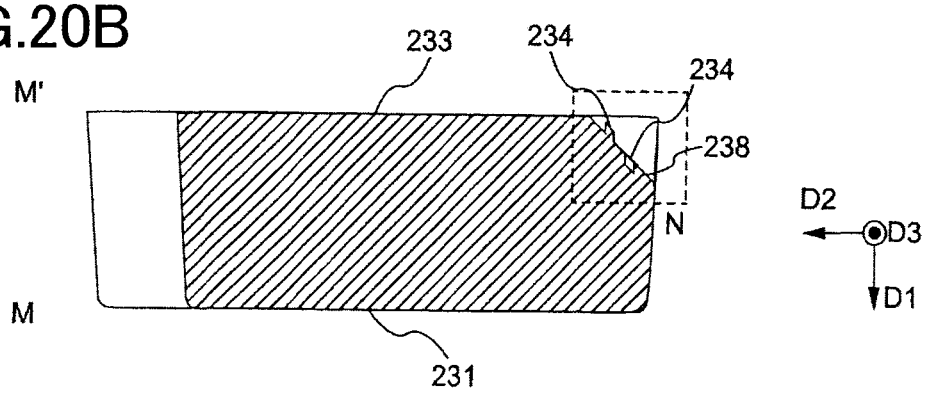
Figure 20C:
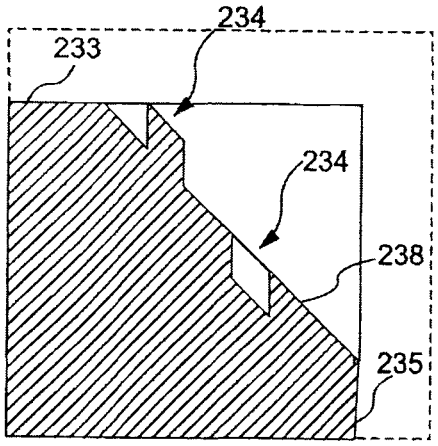
Figure 20D:
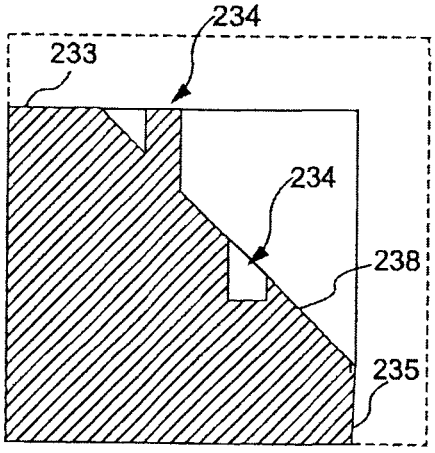

As illustrated in FIGS. 18C and 19C, the second identifier 234*e* in the present modification includes a protruding structure including: a side surface 2342*e* (as one example of the second surface); a side surface 2343*e* (as one example of the third surface) opposed to the side surface 2342*e*; side surfaces 2345*e* (each as one example of the fifth surface) connecting the side surface 2342*e* and the side surface 2343*e* to each other; and an upper surface 2344*e* (as one example of the fourth surface) connecting the side surfaces to each other. The side surface 2342*e* (as one example of the second surface) of the protruding structure continues to the surface 238*e* (as one example of the first surface) at the obtuse angle b1. The side surface 2343*e* (as one example of the third surface) of the protruding structure which is opposed to the side surface 2342*e* (as one example of the second surface) of the protruding structure continues to the surface 238*e* (as one example of the first surface) at the acute angle b2. Each of the side surfaces 2345*e* (each as one example of the fifth surface) of the protruding structure continues to the surface 238*e* (as one example of the first surface) at the substantially perpendicular angle b3 so as to connect the side surface 2342*e* (as one example of the second surface) and the side surface 2343*e* (as one example of the third surface) of the protruding structure to each other. Each of the side surface 2342*e*, the side surface 2343*e*, and the side surfaces 2345*e* of the protruding structure has surface roughness different from that of the surface 238*e* (as one example of the first surface).

Each of the side surface 2342*e* (as one example of the second surface), the side surface 2343*e* (as one example of the third surface), and the side surfaces 2345*e* (each as one example of the fifth surface) is substantially perpendicular to the surface 233*e* opposed to the connecting surface 231*e*. That is, each of the side surface 2342*e* (as one example of the second surface), the side surface 2343*e* (as one example of the third surface), and the side surfaces 2345*e* (each as one example of the fifth surface) is substantially perpendicular to the pivotal direction of the hammer assembly 200*e* (the D2 direction in FIG. 3). The angle of each of the side surface 2342*e* (as one example of the second surface), the side surface 2343*e* (as one example of the third surface), and the side surfaces 2345*e* (each as one example of the fifth surface) with respect to the surface 235*e* continuing to the connecting surface 231*e* is less than the angle of each of the side surface 2342*e* (as one example of the second surface), the side surface 2343*e* (as one example of the third surface), and the side surfaces 2345*e* (each as one example of the fifth surface) with respect to the surface 233*e* opposed to the connecting surface 231*e*. The side surface 2342*e* (as one example of the second surface) and the side surface 2343*e* (as one example of the third surface) opposed to each other are substantially parallel with each other. However, the present disclosure is not limited to this configuration. For example, each of the side surface 2342*e* (as one example of the second surface), the side surface 2343*e* (as one example of the third surface), and the side surfaces 2345*e* (each as one example of the fifth surface) may not be perpendicular to the surface 233*e*. The side surface 2342*e* (as one example of the second surface) and the side surface 2343*e* (as one example of the third surface) opposed to each other may not be parallel with each other. In this case, the protruding structure formed by the side surface 2342*e* (as one example of the second surface), the side surface 2343*e* (as one example of the third surface), the side surfaces 2345*e* (each as one example of the fifth surface), and the upper surface 2344*e* (as one example of the fourth surface) preferably has a tapered shape. The side surface 2342*e* (as one example of the second surface) and the side surface 2343*e* (as one example of the third surface) opposed to each other may be connected to each other while intersecting each other in the protruding direction.

At least a portion of the side surface 2342*e* (as one example of the second surface) is visually recognizable in a direction orthogonal to the surface 238*e* (as one example of the first surface). Since the side surface 2342*e* (as one example of the second surface) of the protruding structure has surface roughness different from that of the surface 238*e* (as one example of the first surface), the second identifier 234*e* is visually recognized easily when viewed in a direction orthogonal to the surface 238*e* (as one example of the first surface). At least a portion of the side surface 2342*e* (as one example of the second surface) is visually recognizable also when viewed from a lower-surface side in the pivotal direction (the D2 direction in FIG. 3). Since the side surface 2342*e* (as one example of the second surface) of the protruding structure has surface roughness different from that of the surface 238*e* (as one example of the first surface), the second identifier 234*e* is visually recognized easily when viewed from a lower-surface side in the pivotal direction (the D2 direction in FIG. 3). This improves the productivity when the weight 230*e* is assembled to the hammer body portion 205*e* and when the hammer assembly 200*e* is assembled to the keyboard apparatus.

The upper surface 2344*e* (as one example of the fourth surface) of the protruding structure connects the side surface 2342*e* (as one example of the second surface), the side surface 2343*e* (as one example of the third surface), and the side surfaces 2345*e* (each as one example of the fifth surface) of the protruding structure to each other in substantially parallel with the surface 238*e* (as one example of the first surface). The upper surface 2344*e* (as one example of the fourth surface) of the protruding structure has surface roughness different from that of the surface 238*e* (as one example of the first surface). The upper surface 2344*e* (as one example of the fourth surface) of the protruding structure has surface roughness different from that of each of the side surface 2342*e* (as one example of the second surface), the side surface 2343*e* (as one example of the third surface), and the side surfaces 2345*e* (each as one example of the fifth surface).

At least a portion of the upper surface 2344*e* (as one example of the fourth surface) is visually recognizable in a direction orthogonal to the surface 238*e* (as one example of the first surface). Since the upper surface 2344*e* (as one example of the fourth surface) of the protruding structure has surface roughness different from that of the surface 238*e* (as one example of the first surface), the second identifier 234*e* is visually recognized easily when viewed in the direction orthogonal to the surface 238*e* (as one example of the first surface). Since the upper surface 2344*e* (as one example of the fourth surface) of the protruding structure has surface roughness different from that of the side surface 2342*e* (as one example of the second surface), the second identifier 234*e* is visually recognized easily when viewed in the direction orthogonal to the surface 238*e* (as one example of the first surface). The upper surface 2344*e* (as one example of the fourth surface) is visually recognizable also when viewed in a direction of assembly of the weight 230*e* to the hammer body portion 205*e* (the pivot-shaft direction and the D1 direction in FIG. 3). Since the upper surface 2344*e* (as one example of the fourth surface) of the protruding structure has surface roughness different from that of the surface 238*e* (as one example of the first surface), the second identifier 234*e* is visually recognized easily when viewed in the direction of the assembly of the weight 230*e* to the hammer body portion 205*e* (the pivot-shaft direction and the D1 direction in FIG. 3). This improves the productivity when the weight 230*e* is assembled to the hammer body portion 205*e* and when the hammer assembly 200*e* is assembled to the keyboard apparatus.

Figure 18D:
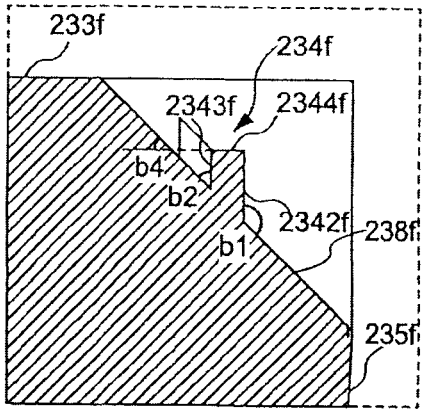

However, the present disclosure is not limited to this configuration. For example, the upper surface 2344*e* (as one example of the fourth surface) of the protruding structure may connect the side surface 2342*e* (as one example of the second surface) and the side surface 2343*e* (as one example of the third surface) of the protruding structure to each other at the angle b4 with respect to the surface 238*e* (as one example of the first surface). FIG. 18D is an enlarged cross-sectional view of a region including a second identifier 234*f* in a modification of the present embodiment. As illustrated in FIG. 18D, the second identifier 234*f* in the present modification includes a protruding structure including a side surface 2342*f* (as one example of the second surface); a side surface 2343*f* (as one example of the third surface) opposed to the side surface 2342*f*; side surfaces 2345*f* (each as one example of the fifth surface) connecting the side surface 2342*f* and the side surface 2343*f* to each other; and an upper surface 2344*f* (as one example of the fourth surface) connecting the side surface 2342*f* and the side surface 2343*f* to each other. The side surface 2342*f* (as one example of the second surface) of the protruding structure continues to a surface 238*f* (as one example of the first surface) at the obtuse angle b1. The side surface 2343*f* (as one example of the third surface) of the protruding structure which is opposed to the side surface 2342*f* (as one example of the second surface) of the protruding structure continues to the surface 238*f* (as one example of the first surface) at the acute angle b2. Each of the side surfaces 2345*f* (each as one example of the fifth surface) of the protruding structure continues to the surface 238*f* (as one example of the first surface) at the substantially perpendicular angle b3 so as to connect the side surface 2342*f* (as one example of the second surface) and the side surface 2343*f* (as one example of the third surface) of the protruding structure to each other. Each of the side surface 2342*f*, the side surface 2343*f*, and the side surfaces 2345*f* of the protruding structure has surface roughness different from that of the surface 238*f*.

At least a portion of the side surface 2342*f* (as one example of the second surface) is visually recognizable in a direction orthogonal to the surface 238*f* (as one example of the first surface). Since the side surface 2342*f* (as one example of the second surface) of the protruding structure has surface roughness different from that of the surface 238*f* (as one example of the first surface), the second identifier 234*f* is visually recognized easily when viewed in the direction orthogonal to the surface 238*f* (as one example of the first surface). At least a portion of the side surface 2342*f* (as one example of the second surface) is visually recognizable also when viewed from a lower-surface side in the pivotal direction (the D2 direction in FIG. 3). Since the side surface 2342*f* (as one example of the second surface) of the protruding structure has surface roughness different from that of the surface 238*f* (as one example of the first surface), the second identifier 234*f* is visually recognized easily when viewed from a lower-surface side in the pivotal direction (the D2 direction in FIG. 3). This improves the productivity when a weight 230*f* is assembled to the hammer body portion 205*f* and when a hammer assembly 200*f* is assembled to the keyboard apparatus.

The upper surface 2344*f* (as one example of the fourth surface) of the protruding structure connects the side surface 2342*f* (as one example of the second surface), the side surface 2343*f* (as one example of the third surface), and the side surfaces 2345*f* (each as one example of the fifth surface) of the protruding structure at the angle b4 with respect to the surface 238*f* (as one example of the first surface). The upper surface 2344*f* (as one example of the fourth surface) of the protruding structure has surface roughness different from that of the surface 238*f* (as one example of the first surface). The upper surface 2344*f* (as one example of the fourth surface) of the protruding structure has surface roughness different from that of each of the side surface 2342*f* (as one example of the second surface), the side surface 2343*f* (as one example of the third surface), and the side surfaces 2345*f* (each as one example of the fifth surface).

At least a portion of the upper surface 2344*f* (as one example of the fourth surface) is visually recognizable in a direction orthogonal to the surface 238*f* (as one example of the first surface). Since the upper surface 2344*f* (as one example of the fourth surface) of the protruding structure has surface roughness different from that of the surface 238*f* (as one example of the first surface), the second identifier 234*f* is visually recognized easily when viewed in the direction orthogonal to the surface 238*f* (as one example of the first surface). Since the upper surface 2344*f* (as one example of the fourth surface) of the protruding structure has surface roughness different from that of the side surface 2342*f* (as one example of the second surface), the second identifier 234*f* is visually recognized easily when viewed in the direction orthogonal to the surface 238*f* (as one example of the first surface). The upper surface 2344*f* (as one example of the fourth surface) is visually recognizable also when viewed in a direction of assembly of the weight 230*f* to the hammer body portion 205*f* (the pivot-shaft direction and the D1 direction in FIG. 3). Since the upper surface 2344*f* (as one example of the fourth surface) of the protruding structure has surface roughness different from that of the surface 238*f* (as one example of the first surface), the second identifier 234*f* is visually recognized easily when viewed in the direction of the assembly of the weight 230*f* to the hammer body portion 205*f* (the pivot-shaft direction and the D1 direction in FIG. 3). This improves the productivity when the weight 230*f* is assembled to the hammer body portion 205*f* and when the hammer assembly 200*f* is assembled to the keyboard apparatus.

FIGS. 18A-18D illustrate the second identifier 234*e* as one protruding structure. However, the present disclosure is not limited to this configuration, and the second identifier 234*e* may be formed by combination of a plurality of protruding structures. The different protruding structures may have different heights, and the protruding structures may be connected to each other. The protruding structure may include another protruding structure. Each of the side surfaces 2322*c* of the protruding structure of the first identifier 232*c* and each of the side surface 2342*e* (as one example of the second surface), the side surface 2343*e* (as one example of the third surface), and the side surfaces 2345*e* (each as one example of the fifth surface) of the protruding structure of the second identifier 234*e* are substantially parallel with each other.

As illustrated in FIGS. 20A-20D, the second identifier 234 may be a combination of the recessed structure in the first embodiment and the protruding structure in the first modification. The second identifier 234 may be a combination of a plurality of recessed structures and a plurality of protruding structures. The recessed structures and the protruding structures may have different heights and may be connected to each other. The recessed structure and the protruding structure may include a recessed structure and a protruding structure.

While the embodiment has been described above, it is to be understood that the disclosure is not limited to the details of the illustrated embodiment, but may be embodied with various changes and modifications, which may occur to those skilled in the art, without departing from the spirit and scope of the disclosure. For example, in the above-described embodiment, the structure is configured such that the angle of the second surface with respect to the first surface is an obtuse angle, and the angle of the third surface with respect to the first surface is an acute angle, as the protruding structure or the recessed structure having a straight cross section. The structure may be configured such that the angle of the second surface with respect to the first surface is an obtuse angle, and the angle of the third surface with respect to the first surface is an acute angle, as a protruding structure or a recessed structure having a tapered cross section (i.e., a trapezoid shape).

Each of the hammer body portion and the weight is constituted by a single component in the above-described embodiment but may be constituted by a plurality of components. For example, the bearing of the hammer body portion may be provided independently. In this case, a plurality of types of bearing components may be prepared to provide a plurality of types of hammer body portions to each of which a corresponding one of the bearing components is assembled, with the hammer body portion other than the bearing component being common. While the connecting surface of the weight 230 (the connecting surface 231 in the embodiment) is a flat surface, at least a portion of the connecting surface of the weight 230 may be constituted by a flat surface, and another portion may be a curved surface continuous to the flat surface, for example. In this case, an identifier needs to be provided on a surface different from the flat surface at the portion. The first identifier 232 and the second identifier may be provided on one flat surface different from the flat surface at the portion.

It is to be understood that the disclosure is not limited to the illustrated embodiment, but may be embodied with various changes and modifications without departing from the spirit and scope of the disclosure. For example, while the hammer assembly is driven by the key in the above-described embodiment, the present disclosure is not limited to this. For example, the hammer assembly may be driven by another action member (e.g., a jack or a support of an action mechanism of an acoustic piano). A supporter for the pivot shaft, a portion for receiving a force from another component, a portion for driving the sensor, and the placement of the weight as a configuration of the hammer assembly are not limited to those in the above-described embodiment and at least needs to be designed as needed in accordance with the configuration of the keyboard. All the functions of the hammer assembly in the present embodiment are not necessarily provided, and the configuration in this case may be designed as needed. For example, in the case where the key drives the sensor, a portion for driving the sensor may be omitted. In the above-described embodiment, the hammer body portion and the weight are independent of each other, with the hammer assembly serving as the pivot member, but the hammer body portion and the weight may be formed as a single hammer. In this case, the single hammer may be formed by the hammer body portion 205 and the weight 230 in the above-described embodiment which are integrally with each other and provided with an identifier.

What is claimed is:

1. A hammer assembly of a keyboard apparatus, the hammer assembly comprising:

a hammer body portion configured to pivot about a pivot axis; and a weight portion comprising a connecting surface, at least a portion of which comprises a flat surface, the weight portion being disposed such that the flat surface and the hammer body portion are opposed to each other, the weight portion comprising at least one surface different from the flat surface, a first identifier and a second identifier being provided on the at least one surface, the first identifier being visually recognizable from a first direction orthogonal to the flat surface, the second identifier being visually recognizable from the first direction and from a second direction in which the first identifier is not visually recognizable, wherein the weight portion includes a first recessed portion in the at least one surface on which the first identifier is provided, and wherein the first identifier and the second identifier are associated with a key of the keyboard apparatus.

2. The hammer assembly according to claim 1, wherein the first identifier comprises a second recessed and protruding structure, and each of a depth of a recessed structure of the second recessed and protruding structure with respect to a surface of the second recessed and protruding structure on which the first identifier is provided and a height of a protruding structure of the second recessed and protruding structure with respect to the surface is less than a depth of the first recessed portion.

3. The hammer assembly according to claim 1, wherein a perimeter of the at least one surface of the weight portion is greater than a perimeter of the connecting surface of the weight portion.

4. The hammer assembly according to claim 1, wherein the at least one surface comprises a first surface intersecting an axial direction of the pivot axis and a direction orthogonal to the axial direction, and wherein the second identifier provided on the first surface comprises a third recessed structure or a third protruding structure comprising:

a second surface connected to the first surface; and a third surface opposed to the second surface, as side surfaces.

5. The hammer assembly according to claim 4, wherein surface roughness of the first surface and surface roughness of the second surface are different from each other.

6. The hammer assembly according to claim 4, wherein an angle of the second surface with respect to the first surface is an obtuse angle, and an angle of the third surface with respect to the first surface is an acute angle.

7. The hammer assembly according to claim 4, wherein the at least one surface comprises a fourth surface connecting the second surface and the third surface to each other and serving a bottom surface of the third recessed structure or an upper surface of the third protruding structure, and surface roughness of the second surface and that of the fourth surface are different from each other.

8. The hammer assembly according to claim 7, wherein surface roughness of the first surface and the surface roughness of the fourth surface are different from each other.

9. The hammer assembly according to claim 4, wherein the weight portion comprises a connecting surface having an at-least-one-flat-surface shape, and the connecting surface and the first member are assembled to each other so as to be opposed to each other, wherein the first surface is connected to at least one of a surface adjacent to the connecting surface and a surface opposed to the connecting surface, and wherein an angle of each of the second surface and the third surface with respect to the surface adjacent to the connecting surface is less than an angle of each of the second surface and the third surface with respect to the surface opposed to the connecting surface.

10. The hammer assembly according to claim 4, wherein the weight portion comprises or a through hole in one of the connecting surface and a surface opposed to the connecting surface, and wherein the first surface and the surface comprising the through hole are connected to each other.

11. The hammer assembly according to claim 10, wherein each of the second surface and the third surface is a side surface of the third recessed structure, and a depth of the third recessed structure is shallower than that of the first recessed portion.

12. A pivot member hammer assembly for an action mechanism of a keyboard instrument, the hammer assembly being provided corresponding to a key of a plurality of keys in the keyboard instrument and arranged in a pivot-axis direction, the hammer assembly comprising:

a connecting surface, at least a portion of which comprises a flat surface, the flat surface and a hammer body portion being disposed so as to be opposed to each other; and at least one surface different from the flat surface, a first identifier and a second identifier being provided on the at least one surface, the first identifier being visually recognizable from the pivot-axis direction, the second identifier being visually recognizable from the pivot-axis direction and a direction orthogonal to the pivot-axis direction, wherein the hammer assembly includes a first recessed portion in the at least one surface on which the first identifier is provided, and wherein the first identifier and the second identifier are associated with the key of the keyboard instrument.

13. A hammer assembly for an action mechanism of a keyboard instrument, hammer assembly being provided corresponding to a key of a plurality of keys in the keyboard instrument and arranged in a pivot-axis direction, the hammer assembly comprising a first identifier and a second identifier, the first identifier being visually recognizable from the pivot-axis direction, the second identifier being visually recognizable from the pivot-axis direction and a direction orthogonal to the pivot-axis direction, wherein the hammer assembly includes a first recessed portion in at least one surface on which the first identifier is provided, and wherein the first identifier and the second identifier are associated with the key of the keyboard instrument.

14. A keyboard apparatus comprising:

a frame;

a plurality of keys pivotably disposed on the frame; and a plurality of hammer assemblies, each hammer assembly arranged respectively corresponding to the plurality of keys, each hammer assembly including:

a hammer body portion configured to pivot about a pivot axis; and a weight portion comprising a connecting surface, at least a portion of which comprises a flat surface, the weight portion being disposed such that the flat surface and the hammer body portion are opposed to each other, the weight portion comprising at least one surface different from the flat surface, a first identifier and a second identifier being provided on the at least one surface, the first identifier being visually recognizable from a first direction orthogonal to the flat surface, the second identifier being visually recognizable from the first direction and from a second direction in which the first identifier is not visually recognizable, wherein the weight portion includes a first recessed portion in the at least one surface on which the first identifier is provided, and wherein the first identifier and the second identifier are associated with a key of the keyboard apparatus, wherein a position of the pivot axis with respect to the frame is fixed, and wherein each of the plurality of hammer assemblies respectively corresponding to the plurality of keys pivots in response to pivotal movement of a corresponding one of the plurality of keys.

15. The keyboard apparatus according to claim 14, wherein each hammer body portion of a plurality of hammer body portions of the plurality of hammer assemblies is classifiable into at least a first-group hammer body portion and a second-group hammer body portion, and wherein an indication manner of the first identifier provided on a weight portion corresponding to the first-group hammer body portion is different from an indication manner of the first identifier provided on the weight portion corresponding to the second-group hammer body portion.

16. The keyboard apparatus according to claim 15, wherein the first identifier provided on the weight portion corresponding to the first-group hammer body portion comprises information corresponding to an arrangement ordinal number of the first-group hammer body portion in an axial direction of the plurality of hammer assemblies.

17. The keyboard apparatus according to claim 14, wherein a mass of the weight portion of a first hammer assembly of the plurality of hammer assemblies is different from that of the weight portion of a second hammer assembly of the plurality of hammer assemblies which is different from the first hammer assembly.

18. The keyboard apparatus according to claim 14, wherein a center of gravity of the weight portion of a first hammer assembly of the plurality of hammer assemblies is different from a center of gravity of the weight portion of a second hammer assembly of the plurality of hammer assemblies which is different from the first hammer assembly.

19. The keyboard apparatus according to claim 15, wherein the second identifier provided on the weight portion corresponding to the second-group hammer body portion comprises information corresponding to an arrangement ordinal number in an axial direction of the plurality of hammer assemblies.

20. The keyboard apparatus according to claim 14, wherein a surface which is one of the at least one surface on which the first identifier is provided is opposed to the flat surface of the weight portion which is adjacent to the surface.

21. The keyboard apparatus according to claim 14, wherein the second identifier is visually recognizable from a pivotal direction of the hammer body portion.

* * * * *